US008465146B2

(12) United States Patent
Satoh et al.

(10) Patent No.: US 8,465,146 B2
(45) Date of Patent: Jun. 18, 2013

(54) ROLL PAPER CONVEYING APPARATUS, INKJET PRINTER, AND ROLL PAPER CONVEYING METHOD

(75) Inventors: Nobuyuki Satoh, Kanagawa (JP); Jun Yamane, Kanagawa (JP); Masato Kobayashi, Kanagawa (JP); Norikazu Taki, Kanagawa (JP); Tatsuhiko Okada, Saitama (JP); Daisaku Horikawa, Saitama (JP); Daisuke Sawada, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 138 days.

(21) Appl. No.: 13/031,936

(22) Filed: Feb. 22, 2011

(65) Prior Publication Data

US 2011/0211031 A1 Sep. 1, 2011

(30) Foreign Application Priority Data

Feb. 26, 2010 (JP) ..... 2010-043038

(51) Int. Cl.
*B41J 2/01* (2006.01)
*B65H 16/10* (2006.01)

(52) U.S. Cl.
USPC ..... 347/104; 242/564

(58) Field of Classification Search
None
See application file for complete search history.

(56) References Cited

U.S. PATENT DOCUMENTS

| | | | |
|---|---|---|---|
| 2009/0121423 | A1 | 5/2009 | Nakamura et al. |
| 2011/0056808 | A1 | 3/2011 | Satoh et al. |

FOREIGN PATENT DOCUMENTS

| | | |
|---|---|---|
| JP | 62-79154 | 4/1987 |
| JP | 62-83968 | 4/1987 |
| JP | 6-234446 | 8/1994 |
| JP | 3182932 | 4/2001 |
| JP | 3436382 | 6/2003 |
| JP | 2004-35226 | 2/2004 |

*Primary Examiner* — Stephen D. Meier
*Assistant Examiner* — Tracey McMillion
(74) *Attorney, Agent, or Firm* — Oblon, Spivak, McClelland, Maier & Neustadt, L.L.P.

(57) ABSTRACT

A movable member encoder is used to detect the position of a movable member, and a correction value calculator calculates a correction value corresponding to the amount of displacement of the movable member from a reference position and the integration of the amount of displacement. The correction value calculated by the correction value calculator is then used in correcting a voltage instruction value output from a feed motor controller to a feed motor.

7 Claims, 15 Drawing Sheets

ROLL PAPER CONVEYING APPARATUS, INKJET PRINTER, AND ROLL PAPER CONVEYING METHOD

CROSS-REFERENCE TO RELATED APPLICATIONS

The present application claims priority to and incorporates by reference the entire contents of Japanese Patent Application No. 2010-043038 filed in Japan on Feb. 26, 2010.

BACKGROUND OF THE INVENTION

1. Field of the Invention

The present invention relates to a roll paper conveying apparatus that conveys roll paper to a predetermined printing position, and also relates to an inkjet printer that uses the roll paper conveying apparatus.

2. Description of the Related Art

In a roll paper compatible printer that uses roll paper as a printing medium to print an image, the amount of the paper to be fed into a printing position must be controlled precisely because the load fluctuates as the amount of remaining roll paper being set changes. If the roll paper is directly pulled by carriage rollers, load fluctuation acts as a disturbance to the control of a conveying motor driving the carriage rollers, resulting in unstable control and therefore desired stop position precision may not be obtained. In addition, if roll paper having a large moment of inertia is directly pulled by the carriage rollers, the carriage rollers might slip on the roll paper to cause the amount of paper to be fed to change, resulting in print deviation even if the conveying motor is precisely controlled.

Therefore, such a roll paper compatible printer includes a driving source for unwinding the roll paper and pulling to covey the roll paper toward the carriage rollers. The driving source for unwinding and pulling the roll paper is provided separately from the conveying motor for driving the carriage rollers. Furthermore, a movable member is arranged upstream of the carriage roller so as to come into contact with the unwound roll paper and apply an optimal tension thereto. Thus, control of the conveying motor may be prevented from being affected adversely by a fluctuation in the load, which fluctuates as the amount of the remaining roll paper changes. Moreover, even if the roll paper slips, the amount of paper to be fed into the printing position can be controlled precisely.

In addition, as a technology related to conveyance of roll paper, Japanese Patent Application Laid-open No. S62-83968 discloses a technology that continuously detects the amount of displacement of a movable member, and increases or decreases the degree of roll paper to be unwound in a manner following the amount of displacement of the movable member to continuously manage pulling and conveying of the roll paper as well as tension thereof. More specifically, the technology disclosed in Japanese Patent Application Laid-open No. S62-83968 converts an encoder pulse corresponding to rotations of a roll paper driving motor for driving a roll paper shaft into a voltage, compares the voltage with a reference voltage, and performs proportional control to bring the difference between the voltage and the reference voltage to zero. The reference voltage is increased or decreased using the resistance of a rotary variable resistor corresponding to the roll paper diameter, and the resistance of a rotary variable resistor corresponding to the position of a movable guide plate.

The movable range of the movable member kept in contact with the roll paper to apply the optimal tension thereto is restricted by the space in which the movable member is installed inside the machine. In particular, when the machine is demanded to be compact, the movable range of the movable member tends to be restricted largely. In the technology disclosed in Japanese Patent Application Laid-open No. S62-83968, the rotations of the roll paper driving motor are controlled correspondingly to the amount of displacement of the movable member (movable guide plate). Thus, even if the amount of displacement of the movable member increases, the movable member is expected to gradually return to its home position (hereinafter, referred to as a "reference position") as the roll paper driving motor is controlled continuously. However, such control lacks responsiveness. While the responsiveness of the control is expected to be improved by increasing the feedback gain, an increase in the feedback gain of the control of the roll paper driving motor that is to unwind and convey the roll paper having a large mass will result in oscillations and an unstable control. Therefore, the feedback gain cannot be increased.

Therefore, in an inkjet printer required to feed the roll paper intermittently in units of the print width to the printing position, it is difficult to bring the movable member to the reference position within a paper feeding cycle even if the technology disclosed in Japanese Patent Application Laid-open No. S62-83968 is applied in an attempt to control the amount of displacement of the movable member. A deviation of the movable member from the reference position gradually accumulates every time the intermittent paper feeding operation is repeated. As a result, the movable member might be displaced out of the movable range, and collide with the inner surface of the housing of the machine or other components inside of the machine, for example, to damage the movable member, to cause vibrations or abnormal noise, or to smear the paper.

SUMMARY OF THE INVENTION

It is an object of the present invention to at least partially solve the problems in the conventional technology.

According to an aspect of the present invention, a roll paper conveying apparatus includes: a carriage roller that is driven by a conveying motor, and intermittently conveys roll paper by an amount of paper to be fed corresponding to a predetermined print width to a predetermined printing position; a paper feeding roller that is driven by a feed motor, unwinds the roll paper, and pulls and conveys the roll paper toward the carriage roller intermittently; a first detecting unit that detects a rotation angle of the paper feeding roller; a feed motor control unit that performs feedback control of the feed motor using a detection value of the first detecting unit so that a conveying speed and a conveying position of the roll paper follow target values; a movable member that is kept in contact with the roll paper at a position between the paper feeding roller and the carriage roller, and is displaced from a reference position to absorb a change in a tensile force of the roll paper caused by a difference between rotation speeds of the paper feeding roller and the carriage roller; a second detecting unit that detects a position of the movable member; and a correcting unit that calculates a correction value corresponding to an amount of displacement of the movable member from the reference position and an integration of the amount of displacement based on a detection value of the second detecting unit and corrects an output of the feed motor control unit using the correction value thus calculated.

According to another aspect of the present invention an inkjet printer that includes the above described roll paper conveying apparatus, the inkjet printer further includes; a printer head that scans the roll paper in a main-scanning direction while conveying of the roll paper is stopped and applies ink to the roll paper intermittently conveyed by the carriage roller included in the roll paper conveying apparatus to the printing position.

According to still another aspect of the present invention, a roll paper conveying method includes: intermittently conveying roll paper by an amount of paper to be fed corresponding to a predetermined print width to a predetermined printing position with a carriage roller that is driven by a conveying motor; unwinding the roll paper, and pulling and conveying the roll paper toward the carriage roller intermittently with a paper feeding roller that is driven by a feed motor; detecting a rotation angle of the paper feeding roller with a first detecting unit that; performing feedback control of the feed motor using a detection value of the first detecting unit so that a conveying speed and a conveying position of the roll paper follow target values of a feed motor control unit; keeping a movable member in contact with the roll paper at a position between the paper feeding roller and the carriage roller, and displacing the movable member from a reference position to absorb a change in a tensile force of the roll paper caused by a difference between rotation speeds of the paper feeding roller and the carriage roller; detecting a position of the movable member with a second detecting unit; and calculating, with a correcting unit, a correction value corresponding to an amount of displacement of the movable member from the reference position and an integration of the amount of displacement based on a detection value of the second detecting unit and correcting an output of the feed motor control unit using the correction value thus calculated.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a roll paper conveying apparatus and an inkjet printer according to the present invention are described below in greater detail with reference to the accompanying drawings.

First Embodiment

Figure 1:
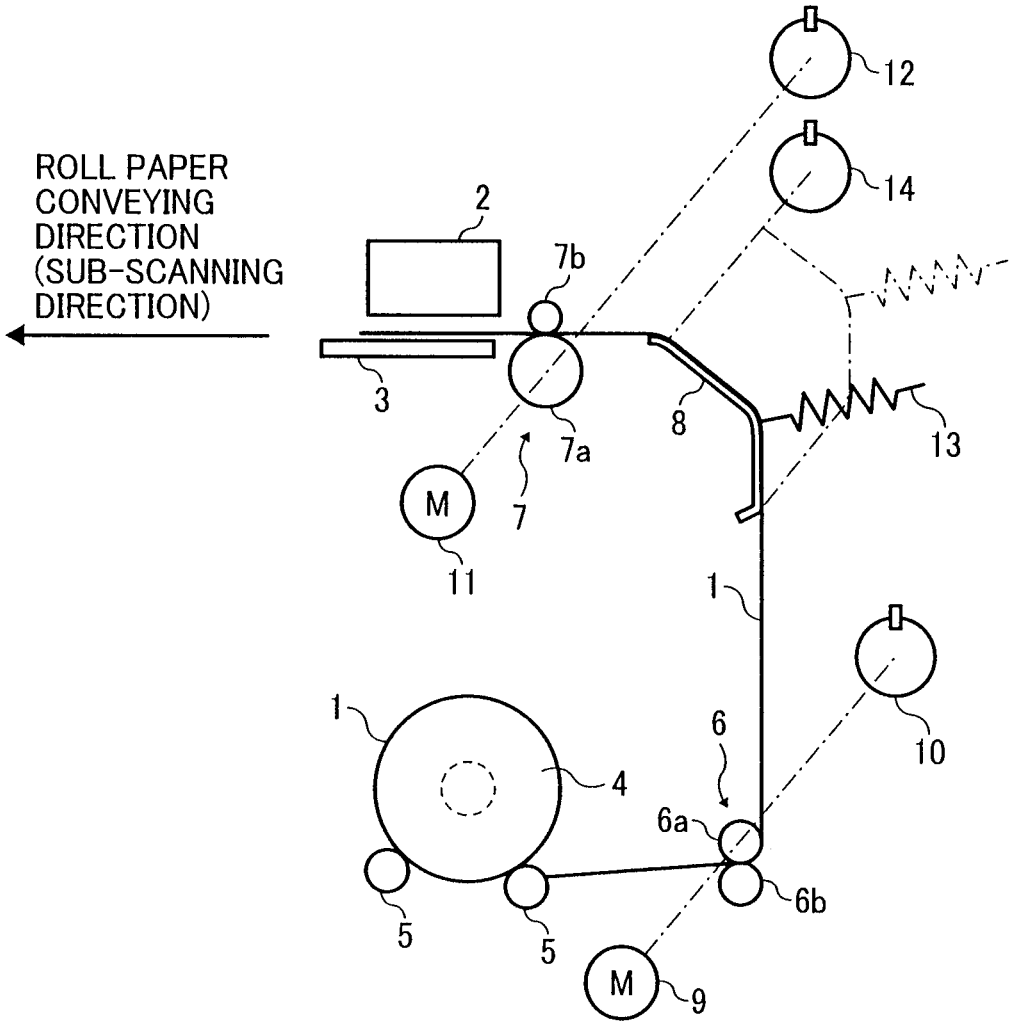
FIG. 1 is a schematic of a general structure of a paper conveying mechanism included in an inkjet printer according to a first embodiment of the present invention.

FIG. 1 is a schematic of a general structure of a paper conveying mechanism included in an inkjet printer according to a first embodiment of the present invention. The inkjet printer according to the first embodiment uses roll paper 1 as a printing medium to print an image, unwinds the roll paper 1 in units of a print width of a printer head 2, and intermittently feeds the roll paper 1 thus unwound along the sub-scanning direction. While the feeding operation of the roll paper 1 is being stopped, the printer head 2 scans the roll paper 1 on a platen 3 along the main-scanning direction (the direction perpendicular to the surface of the paper illustrated in FIG. 1) while applying ink thereto to print a desired image onto the roll paper 1.

A pair of flanges 4 holds the roll paper 1 used as the printing medium and wound in a roll from both ends thereof along the width directions, and the roll paper 1 held between the flanges 4 is set at a predetermined paper mounting position inside of the inkjet printer. The flanges 4 holding both ends of the roll paper 1 are connected to each other at a central shaft about which the roll paper 1 is wound, and placed on flange guides 5. The flange guides 5 are configured to be rotatable, and the flanges 4 are rotated by the rotations of the flange guide 5 to unwind the roll paper 1. The flange guide 5 may be configured to be freely rotatable, or rotated by the driving force of a paper feeding motor 9 (denoted by "M" in FIG. 1), which is to be explained later, being communicated thereto.

Paper feeding rollers 6 are arranged upstream in the conveying path of the roll paper 1 inside of the inkjet printer, and carriage rollers 7 are arranged downstream (immediately before the printing position) in the conveying path. A movable member 8 kept in contact with the roll paper 1 to apply an optimal tension thereto is arranged at a position between the paper feeding rollers 6 and the carriage rollers 7 in the conveying path of the roll paper 1.

The paper feeding rollers 6 include a pair of rollers 6*a* and 6*b* arranged adjacent to each other. One of the rollers 6*a* and 6*b*, which is the roller 6*a*, is a driving roller that is driven to rotate by the paper feeding motor 9. The other roller 6*b* is a driven roller rotated by the rotations of the driving roller 6*a*. The paper feeding rollers 6 are driven by the paper feeding motor 9 while nipping the roll paper 1 in the nip between the rollers 6*a* and 6*b* to unwind and to intermittently pull and convey the roll paper 1 toward the carriage rollers 7.

An encoder (hereinafter, referred to as a "paper feeding encoder 10") is connected to the rotating shaft of the paper feeding roller 6 (6*a*) to detect the rotation angle (rotated position) of the paper feeding roller 6. Various types of encoders that are generally known may be used as the paper feeding encoder 10, such as a transparent encoder and a reflective encoder. Information of the rotated position of the paper feeding roller 6 detected by the paper feeding encoder 10 is input to a motor control unit 21 that will be explained later. Instead of detecting the rotated position of the paper feeding roller 6 directly by connecting the paper feeding encoder 10 to the paper feeding roller 6; an encoder may be connected to the paper feeding motor 9 to detect the rotated position of the paper feeding motor 9; and the rotated position of the paper feeding rollers 6 may be calculated from the rotated position of the paper feeding motor 9, the gear reduction ratio, and so on.

The carriage rollers 7 include a pair of rollers 7*a* and 7*b* arranged adjacent to each other. One of the rollers 7*a* and 7*b*, which is the roller 7*a*, is a driving roller that is driven to rotate by a conveying motor 11 (denoted by "M" in FIG. 1). The other roller 7*b* is a driven roller rotated by the rotations of the driving roller 7*a*. The driven roller 7*b* is biased against the driving roller 7*a* by a non-illustrated pressing unit to increase the paper maintaining force in the nip between the rollers 7*a* and 7*b*. The carriage rollers 7 nip the roll paper 1 between the rollers 7*a* and 7*b*, and are driven by the conveying motor 11 to convey the roll paper 1 intermittently to the printing position on the platen 3 in the units of a paper feeding amount corresponding to the print width covered by a single scan of the printer head 2.

An encoder (hereinafter, referred to as a "conveyance encoder 12") is connected to the rotating shaft of the carriage roller 7 (7*a*) in a similar way as to the paper feeding roller 6 to allow the conveyance encoder 12 to detect the rotation angle (rotated position) of the carriage roller 7. In the similar way as for the paper feeding encoder 10, various types of encoders that are generally known may be used as the conveyance encoder 12. Information of the rotated position of the carriage rollers 7 detected by the conveyance encoder 12 is input to the motor control unit 21 that will be explained later. Instead of connecting the conveyance encoder 12 to the carriage rollers 7 to directly detect the rotated position of the carriage roller 7, an encoder may be provided to the conveying motor 11 to detect the rotated position of the conveying motor 11, and the rotated position of the carriage roller 7 may be calculated from the rotated position of the conveying motor 11, the gear reduction ratio, and so on.

One end of the movable member 8 is supported by a shaft, and the other end is a free end. The movable member 8 suspended by a spring 13 is kept contact with the roll paper 1 at a position between the paper feeding rollers 6 and the carriage rollers 7 to apply an optimal tension to the roll paper 1. The movable member 8 rotates about the shaft by stretching and shrinking the spring 13 while the roll paper 1 is conveyed, and is displaced from a reference position (home position) to absorb a change in the tension of the roll paper 1 (an error in unwound amount of the roll paper 1) caused by a difference of rotation speeds between the paper feeding rollers 6 and the carriage rollers 7. The shaft supporting one end of the movable member 8 may be the same shaft as the rotating shaft of the carriage roller 7, and the movable member 8 may be rotated about the rotating shaft of the carriage roller 7.

An encoder (hereinafter, referred to as a "movable member encoder 14") is disposed in the vicinity of the movable member 8 to detect the position of the movable member 8. Information of the position of the movable member 8 detected by the movable member encoder 14 is input to the motor control unit 21 that will be explained later in the same manner as the information of the rotated position of the paper feeding roller 6 detected by the paper feeding encoder 10 and the information of the rotated position of the carriage roller 7 detected by the conveyance encoder 12.

Figure 2:
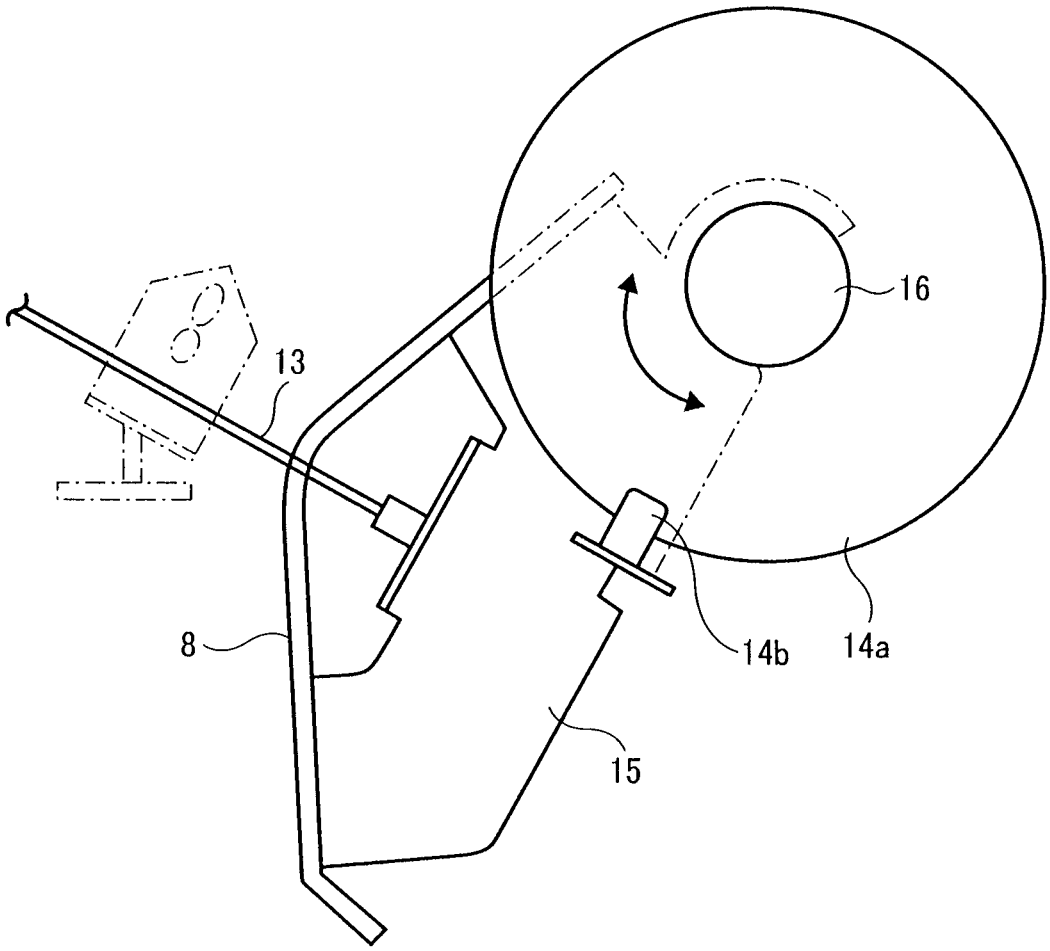
FIG. 2 is an enlarged view of relevant portions near a movable member.

FIG. 2 is an enlarged view of relevant portions in the vicinity of the movable member 8. The movable member 8 is attached rotatably about the axis of a shaft 16 via an attachment member 15 as illustrated in FIG. 2. A tip of the spring 13 is fixed onto the attachment member 15, and the spring 13 is stretched or shrunk correspondingly to the load applied to the movable member 8 to rotate and to displace the movable member 8 about the shaft 16. A slit disk 14*a* is fixed onto the shaft 16, and an encoder sensor 14*b* is fixed onto the attachment member 15. The slit disk 14*a* and the encoder sensor 14*b* function as the movable member encoder 14 that detects the position of the movable member 8.

In an inkjet printer, the paper feed precision directly affects the printing quality, therefore the carriage rollers 7 need to convey the roll paper 1 to the printing position precisely in the units of the print width covered by a single scan of the printer head 2. As the roll paper 1 is consumed, the mass of the roll paper 1 wound in a roll changes. Thus, the effect of the changing load in conveying the roll paper 1 should not be carried over to the carriage rollers 7. To address this issue, the inkjet printer according to the first embodiment uses the paper feeding rollers 6 to unwind the roll paper 1 and to pull and convey the roll paper 1 to the carriage rollers 7, and the movable member 8 is arranged between the paper feeding rollers 6 and the carriage rollers 7. The movable member 8 is arranged to absorb the difference between the amount of the paper conveyed by the paper feeding rollers 6 and the amount of the paper conveyed by the carriage rollers 7 by being displaced.

Load torque, imposed on the paper feeding rollers 6 at times of starting (accelerating) and stopping (decelerating) of rotations, is extremely high compared to load torque imposed on the carriage rollers 7 because the paper feeding rollers 6 directly pull the roll paper 1. At the same time, the speeds of acceleration and deceleration cannot be increased because an available electric current is limited. However, in the carriage rollers 7, the speeds of acceleration and deceleration are kept as high as possible within a range that an exact stop position can be ensured because the paper needs to be conveyed quickly to reduce the time required in printing as much as possible. Therefore, the amount of the paper conveyed by the paper feeding rollers 6 transiently becomes different from the amount of the paper conveyed by the carriage rollers 7 to generate a force in a direction to increase the tension of the roll paper 1 during acceleration, and to generate a force in a direction to decrease the tension of the roll paper 1 during deceleration. Such a change in the tension of the roll paper 1 can be absorbed by the movable member 8 being displaced from the reference position located between the paper feeding rollers 6 and the carriage rollers 7. However, the movable member 8 has a movable range that is dependent on the layout of components arranged inside of the inkjet printer. Thus, if the movable member 8 is moved exceeding the movable range, the movable member 8 might collide with the inner surface of the housing of the inkjet printer or other components inside of the housing, for example, to damage the movable member, to cause vibrations or abnormal noise, or to smear the paper.

The motor control unit 21, to be explained later, performs feedback control of the paper feeding motor 9 driving the paper feeding roller 6 and the conveying motor 11 driving the carriage roller 7 to control the positions and the speeds thereof; the amount of the paper conveyed by the paper feeding rollers 6 and the amount of the paper conveyed by the carriage rollers 7 are expected to gradually reach the same level; and the movable member 8 is expected to return to the reference position after a sufficient time elapses. However, because the inkjet printer must feed the paper intermittently in units of the print width of the printer head 2 and because the paper feeding cycle is short, it is difficult to make the amount of the paper conveyed by the paper feeding rollers 6 the same as the amount of the paper conveyed by the carriage rollers 7 and to allow the movable member 8 to return to the reference position within the paper feeding cycle. Moreover, the paper feeding rollers 6 pulling and conveying the roll paper 1 might slip on the roll paper 1. Therefore, even if the paper feeding rollers 6 and the carriage rollers 7 are controlled to be rotated to convey the same amount of paper, the actual amounts of paper conveyed by the paper feeding rollers 6 and the carriage rollers 7 could be different, and such a difference will appear as a displacement of the movable member 8. As a result, such a displacement of the movable member 8 could gradually accumulate to cause the movable member 8 to be displaced out of the movable range.

It is also conceivable to increase the gain of the feedback control applied to the paper feeding motor 9 driving the paper feeding roller 6, so that the responsiveness of the paper feeding rollers 6 is improved and the movable member 8 is returned to the reference position within the short paper feeding cycle. However, if the feedback gain is increased to control the paper feeding motor 9 having a large load, the paper feeding motor 9 might oscillate, and the control might become unstable. Therefore, the feedback gain cannot be increased excessively.

Thus, the inkjet printer according to the first embodiment uses the movable member encoder 14 to detect the position of the movable member 8, and the position information of the movable member 8 detected by the movable member encoder 14 is input to the motor control unit 21. The motor control unit 21 then calculates a correction value corresponding to the amount of displacement of the movable member 8 from the reference position and the integration of the amount of displacement. A controlling output to the paper feeding motor 9 is corrected based on the correction value thus calculated, so that the amount of displacement of the movable member 8 is controlled responsively within the short paper feeding cycle. In this manner, the movable member 8 is effectively prevented from moving out of the movable area, so that damages of the movable member 8 caused by the movable member 8 colliding with the inner surface of the housing of the inkjet printer, vibrations or abnormal noise, or smearing of the paper can be avoided.

Figure 3:
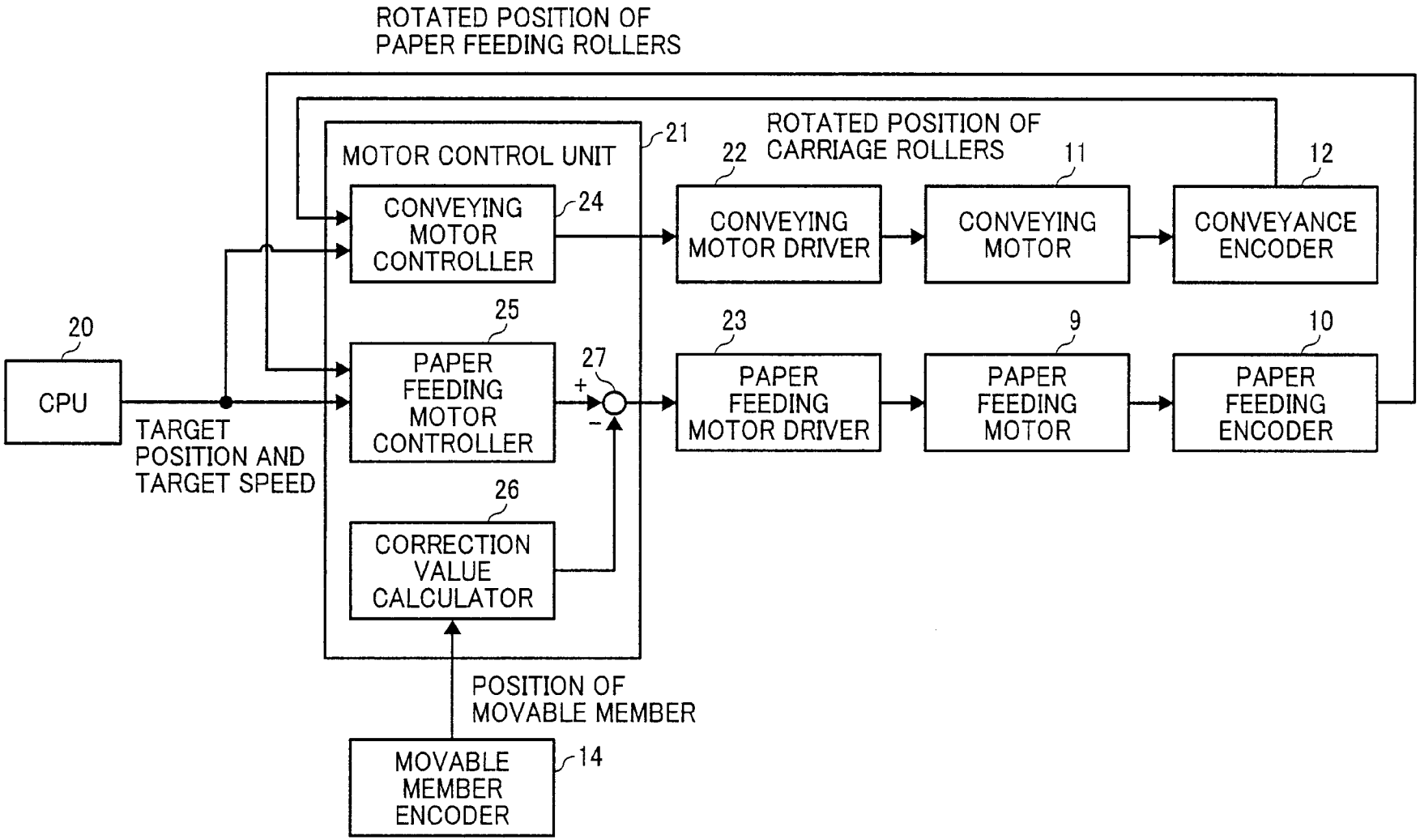
FIG. 3 is a block diagram of a configuration of a control system related to conveyance of paper in the inkjet printer according to the first embodiment.

FIG. 3 is a block diagram of a configuration of a control system related to conveyance of paper in the inkjet printer according to the first embodiment. The inkjet printer according to the first embodiment includes a CPU 20 (central processing unit), a motor control unit 21, a conveying motor driver 22, and a paper feeding motor driver 23 as a control function related to the conveyance of paper.

The CPU 20 is a high level control device that controls the entire operations of the inkjet printer. The CPU 20 issues commands instructing a target of the conveying speed (maximum speed) of the roll paper 1 and a target of the conveying position (stop position) to the motor control unit 21. The speed-related command issued by the CPU 20 to the motor control unit 21 may be any command as long as it functions as a reference upon controlling the speed, and may instruct an average speed, instead of the maximum speed, for example.

The motor control unit 21 receives inputs of the commands issued by the CPU 20, the detected position received from the conveyance encoder 12, the detected position received from the paper feeding encoder 10, and the detected position received from the movable member encoder 14, and outputs a voltage instruction value to the conveying motor driver 22 and to the paper feeding motor driver 23 to control driving of the conveying motor 11 and the paper feeding motor 9. The motor control unit 21 includes a conveying motor controller 24, a paper feeding motor controller 25, a correction value calculator 26, and a subtractor 27.

Based on the command issued by the CPU 20 and the position information received from the conveyance encoder 12, the conveying motor controller 24 calculates a voltage value to be supplied to the conveying motor 11 at a predetermined time interval (hereinafter, referred to as a "control cycle") to make the conveying speed and the conveying position of the roll paper 1 conveyed to the printing position by the carriage rollers 7 follow the targets. The voltage value calculated by the conveying motor controller 24 is then input to the conveying motor driver 22 as the voltage instruction value.

Based on the command issued by the CPU 20 and the position information received from the paper feeding encoder 10, the paper feeding motor controller 25 calculates a voltage value to be supplied to the paper feeding motor 9 at the control cycle to cause the conveying speed and the conveying position of the roll paper 1 pulled and conveyed by the paper feeding rollers 6 to the carriage rollers 7 to follow the targets. The voltage value calculated by the paper feeding motor controller 25 is then corrected with the correction value calculated by the correction value calculator 26, and is input into the paper feeding motor driver 23 as the voltage instruction value.

Based on the position information received from the movable member encoder 14, the correction value calculator 26 calculates a correction value corresponding to the amount of displacement of the movable member 8 from the reference position and the integration of the amount of displacement (voltage that is proportional to the amount of displacement and the integration of the amount of displacement) at the control cycle. The subtractor 27 subtracts (or adds) the correction value (voltage) calculated by the correction value calculator 26 from (or to) the voltage value calculated by the paper feeding motor controller 25 to correct the voltage value calculated by the paper feeding motor controller 25, and outputs the voltage value thus corrected to the paper feeding motor driver 23 as the voltage instruction value.

Figure 4:
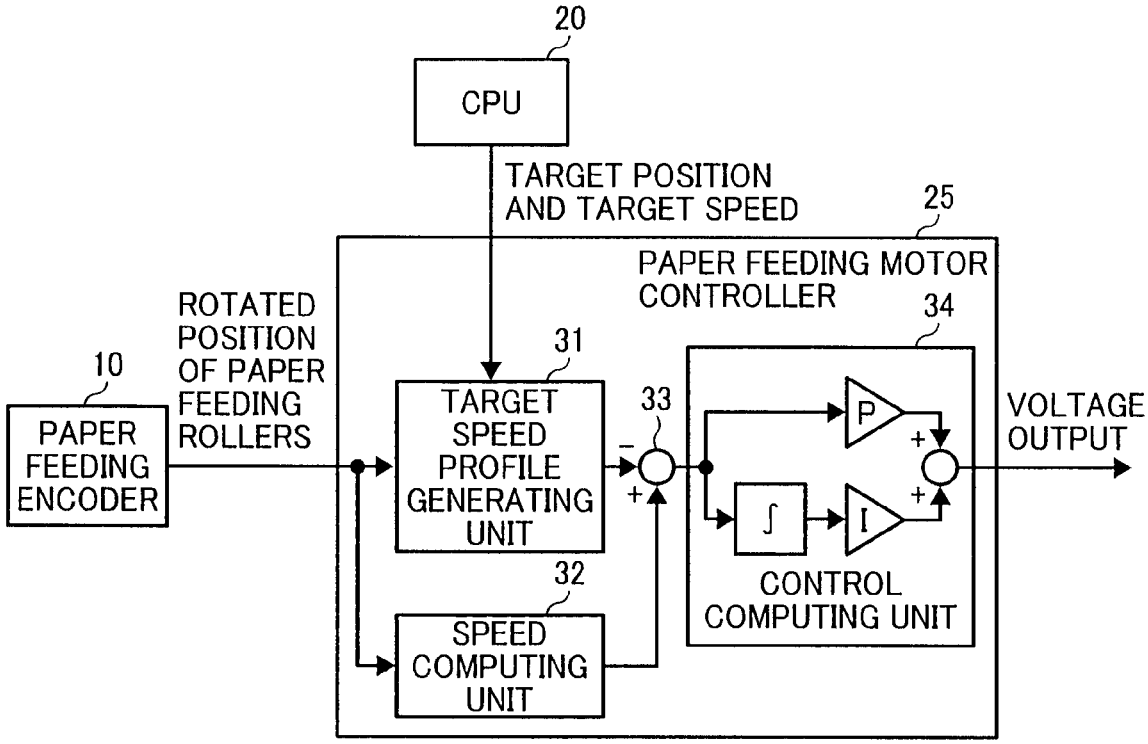
FIG. 4 is a block diagram of a detailed internal configuration of a feed motor controller.

FIG. 4 is a block diagram of a detailed internal configuration of the paper feeding motor controller 25. The paper feeding motor controller 25 includes a target speed profile generating unit 31, a speed computing unit 32, a subtractor 33, and a control computing unit 34.

The target speed profile generating unit 31 generates a target speed profile for the rotation speed of the paper feeding roller 6, that is, a target speed profile of the conveying speed of the roll paper 1 pulled and conveyed by the paper feeding rollers 6 toward the carriage rollers 7 based on the target conveying speed (maximum speed) and the target conveying position (stop position) of the roll paper 1 instructed by the CPU 20, and the rotated position of the paper feeding roller 6 detected by the paper feeding encoder 10. The target speed profile represents a target speed that changes in time series at every control cycle, and is generated based on preset parameters as a target speed for the every control cycle to allow the roll paper 1 to be conveyed appropriately in the manner instructed by the command issued by the CPU 20 depending on the current operations of the paper feeding rollers 6. In other words, the target speed profile generating unit 31 calculates a target speed that changes in time series at every control cycle based on the predetermined parameters.

The speed computing unit 32 calculates the current rotation speed of the paper feeding roller 6, that is, the current conveying speed of the roll paper 1 pulled and conveyed by the paper feeding rollers 6 toward the carriage rollers 7 based on the difference between the rotated position of the paper feeding roller 6 detected by the paper feeding encoder 10 and the rotated position of the paper feeding roller 6 detected by the paper feeding encoder 10 at a previous control cycle.

The subtractor 33 calculate the difference between the current target speed calculated by the target speed profile generating unit 31 and the current conveying speed of the roll paper 1 calculated by the speed computing unit 32. The control computing unit 34 calculates a voltage that needs to be applied to the paper feeding motor 9 to bring the difference calculated by the subtractor 33 to zero, using a proportional-integral (PI) control.

Figure 5:
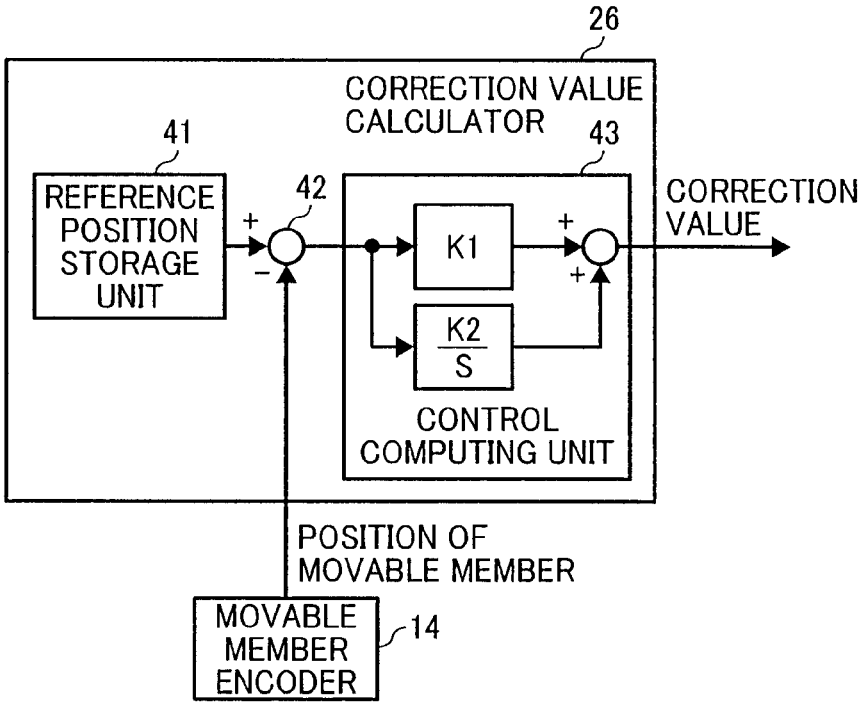
FIG. 5 is a block diagram of a detailed internal configuration of a correction value calculator.

FIG. 5 is a block diagram of a detailed internal configuration of the correction value calculator 26. The correction value calculator 26 includes a reference position storage unit 41, a subtractor 42, and a control computing unit 43.

The reference position storage unit 41 stores therein a reference position (home position) that is a control target for positioning the movable member 8. The subtractor 42 calculates the difference between the reference position of the movable member 8 stored in the reference position storage unit 41 and the current position of the movable member 8 detected by the movable member encoder 14, that is, the amount of displacement of the movable member 8 from the reference position. The control computing unit 43 receives an input of the amount of displacement of the movable member 8 calculated by the subtractor 42, and outputs a voltage proportional to the amount of displacement of the movable member 8 and the integration of the amount of displacement as a correction value for correcting the output of the paper feeding motor controller 25. In FIG. 5, S is a Laplace operator, and K1 and K2 are proportional constants.

As described above, in the inkjet printer according to the first embodiment, the correction value calculator 26 calculates a correction value corresponding to the amount of displacement of the movable member 8 from the reference position and the integration of the amount of displacement; and the output of the paper feeding motor controller 25 is corrected using the correction value calculated by the correction value calculator 26, so that the amount of displacement of the movable member 8 is controlled responsively within the short paper feeding cycle corresponding to the print width of the printer head 2 to prevent the movable member 8 from being displaced out of the movable range. An operation of the movable member 8 when the output of the paper feeding motor controller 25 is corrected using the correction value calculated by the correction value calculator 26 will now be explained, comparing with an example in which such a correction is not applied.

Figure 6A:
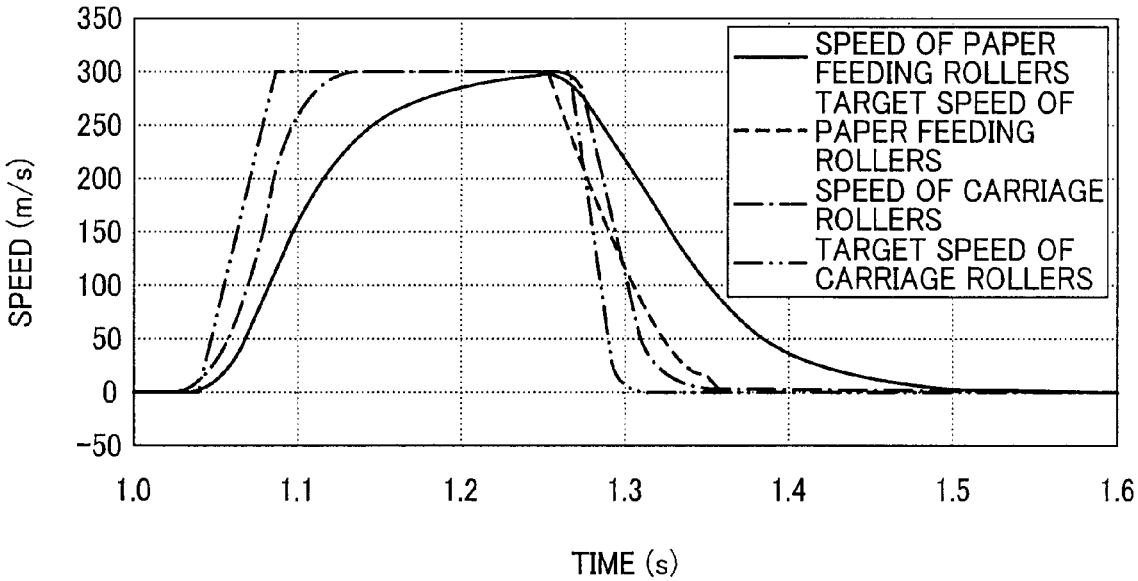
FIG. 6A is a graph of transitions of the conveying speed of roll paper conveyed by paper feeding rollers and the conveying speed of the roll paper conveyed by the carriage rollers without correcting the output of the feed motor controller.
Figure 6B:
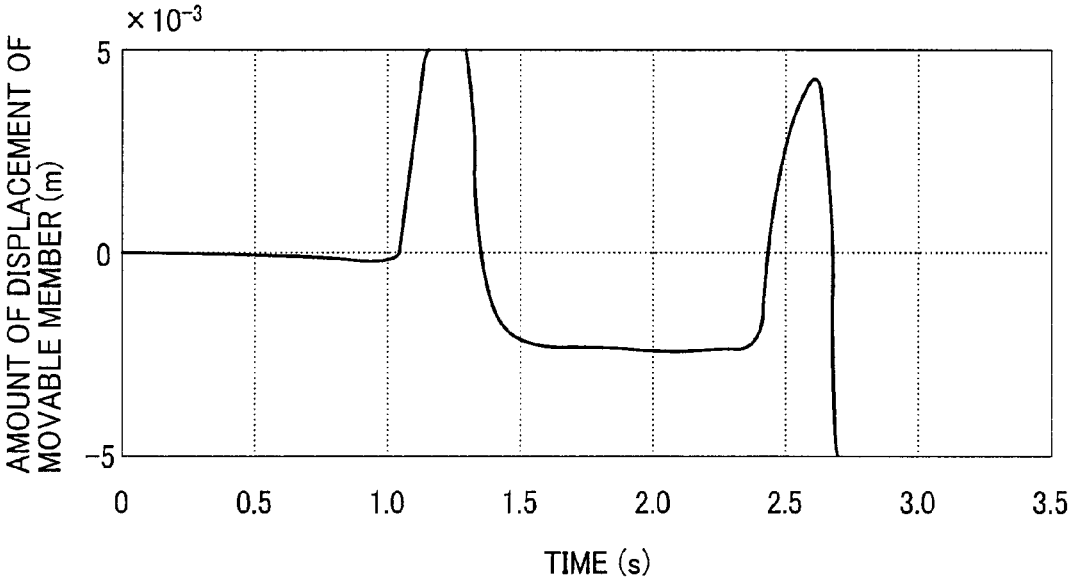
FIG. 6B is a graph of a transition of the amount of displacement of the movable member without correcting the output of the feed motor controller.

FIG. 6A is a graph of transitions of the conveying speed of the roll paper 1 conveyed by the paper feeding rollers 6 and the conveying speed of the roll paper 1 conveyed by the carriage rollers 7 without correcting the output of the paper feeding motor controller 25. FIG. 6B is a graph of a transition of the amount of displacement of the movable member 8 in the example illustrated in FIG. 6A. In FIG. 6A, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25. In FIG. 6A, the graph drawn in the long dashed short dashed line represents the transition of the conveying speed of the roll paper 1 conveyed by the carriage rollers 7 at the paper feeding cycle, and the graph drawn in the long dashed double-short dashed line represents the target speed profile generated by the conveying motor controller 24. FIG. 6B indicates the amount of displacement of the movable member 8 over two paper feeding cycles, and the direction toward+represents the amount of displacement in the direction to reduce the amount of the roll paper 1 unwound between the paper feeding rollers 6 and the carriage rollers 7, and the direction toward−represents the amount of displacement to increase the amount of the unwound roll paper 1.

It is understood from FIG. 6A that the conveying speed of the roll paper 1 conveyed by the carriage rollers 7 follows the target speed profile generated by the conveying motor controller 24 relatively responsibly. On the contrary, the conveying speed of the roll paper 1 conveyed by the paper feeding rollers 6 is less responsive while the speed is accelerated or decelerated, and unable to keep up with the target speed profile generated by the paper feeding motor controller 25. This is because the feedback gain of the paper feeding motor controller 25 for controlling driving of the paper feeding motor 9 having a large load cannot be increased to keep the control stable.

As described above, because the conveying speed of the roll paper 1 conveyed by the paper feeding rollers 6 is less responsive than the conveying speed of the roll paper 1 conveyed by the carriage rollers 7, when the conveying speed of the roll paper 1 is accelerated toward the maximum speed (at 1.1 seconds or so in the time axis), the movable member 8 is displaced in the direction to reduce the amount of the roll paper 1 unwound between the paper feeding rollers 6 and the carriage rollers 7 as illustrated in FIG. 6B. On the contrary, when the conveying speed of the roll paper 1 is decelerated from the maximum speed (at 1.4 seconds or so in the time axis), the movable member 8 is displaced in the direction to increase the amount of the roll paper 1 unwound between the paper feeding rollers 6 and the carriage rollers 7. When the paper feeding rollers 6 and the carriage rollers 7 are stopped (at 1.5 seconds or so in the time axis), the movable member 8 stops in a condition being displaced in the direction to increase the amount of the roll paper 1 unwound between the paper feeding rollers 6 and the carriage rollers 7 because the paper feeding rollers 6 stop later in time.

At this time, because the paper feeding motor controller 25 performs feedback control to position the paper feeding rollers 6, if a high feedback gain is set, it can be expected for the paper feeding rollers 6 to overcome the friction at a condition being stopped and to move, and for the movable member 8 to gradually return to the reference position. However, the movable member 8 stops at a position displaced from the reference position because, as mentioned earlier, the feedback gain of the paper feeding motor controller 25 cannot be increased to keep the control stable. The explanation above assumes that a large amount of the roll paper 1 remains in the roll, and the paper feeding rollers 6 are less responsive than the carriage rollers 7 are. However, the movable member 8 may stop at a position being displaced in the opposite direction, if a small amount of the roll paper 1 remains and the paper feeding rollers 6 are more responsive than the carriage rollers 7 are.

The inkjet printer performs the paper feed operation intermittently and repeatedly at the short paper feeding cycle corresponding to the print width of the printer head 2, therefore if the movable member 8 stops at a position displaced from the reference position, the displacement will gradually accumulate at the paper feeding cycle. Thus, the movable member 8 may eventually be displaced outside of the movable range, and collide with the inner surface of the housing of the inkjet printer, for example, to damage the movable member 8, to cause vibrations or abnormal noise, or to smear the paper.

Figure 7A:
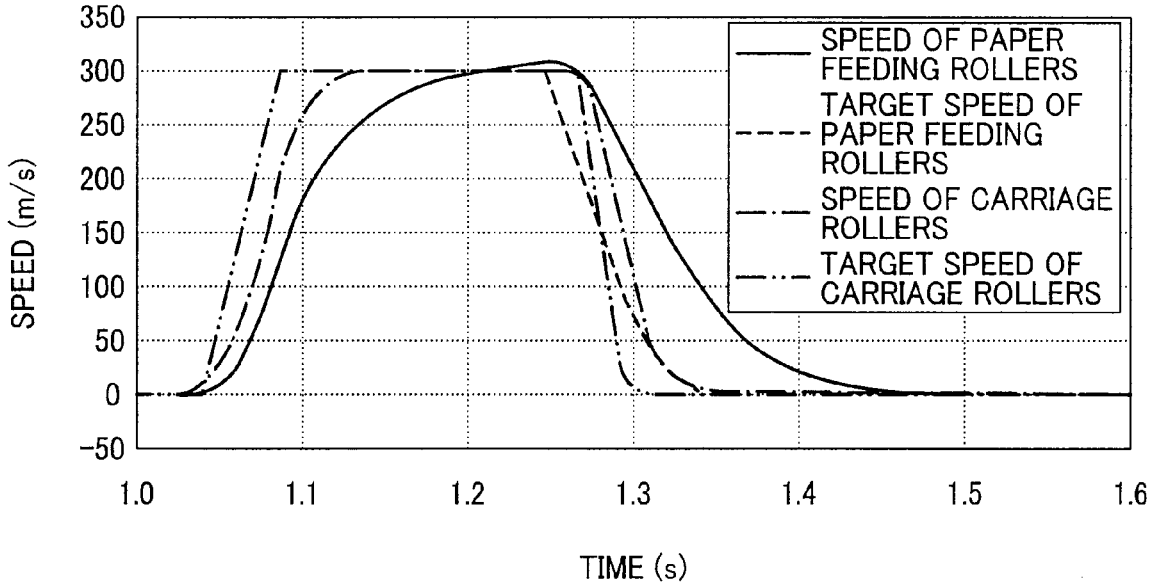
FIG. 7A is a graph of transitions of the conveying speed of the roll paper conveyed by the paper feeding rollers and the conveying speed of the roll paper conveyed by the carriage rollers with the output of the feed motor controller corrected.
Figure 7B:
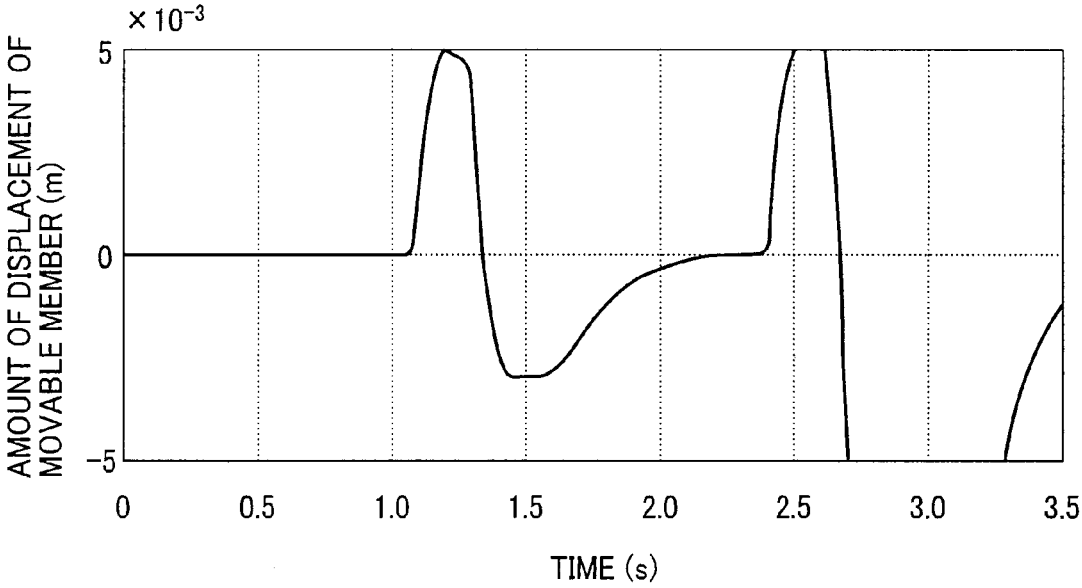
FIG. 7B is a graph of a transition of the amount of displacement of the movable member with the output of the feed motor controller corrected.

FIG. 7A is a graph of transitions of the conveying speed of the roll paper 1 conveyed by the paper feeding rollers 6 and the conveying speed of the roll paper 1 conveyed by the carriage rollers 7 with the output of the paper feeding motor controller 25 corrected based on the amount of displacement of the movable member 8 from the reference position and the integration of the amount of displacement. FIG. 7B is a graph of a transition of the amount of displacement of the movable member 8 in the example illustrated in FIG. 7A. In FIG. 7A, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25. In FIG. 7A, the graph drawn in the long dashed short dashed line represents the transition of the conveying speed of the roll paper 1 conveyed by the carriage rollers 7 at the paper feeding cycle, and the graph drawn in the long dashed double-short dashed line represents the target speed profile generated by the conveying motor controller 24. FIG. 7B indicates the amount of displacement of the movable member 8 over two paper feeding cycles, and the direction toward+represents the amount of displacement in the direction to reduce the amount of the roll paper 1 unwound between the paper feeding rollers 6 and the carriage rollers 7, and the direction toward—represents the amount of displacement to increase the amount of the unwound roll paper 1.

As is clear from comparison between the graph in solid line illustrated in FIG. 7A and the graph in solid line illustrated in FIG. 6A, when the output of the paper feeding motor controller 25 is corrected based on the amount of displacement of the movable member 8 from the reference position and the integration of the amount of displacement, the conveying speed of the roll paper 1 conveyed by the paper feeding rollers 6 temporarily increases to a level exceeding the target speed (at 1.25 seconds or so in the time axis). In this manner, the time required for the paper feeding rollers 6 to stop is reduced, and as a result, the responsiveness at the time of deceleration is improved.

As to the movement of the movable member 8, as illustrated in FIG. 7B, the maximum amount of displacement during the time when the paper feeding rollers 6 are accelerating is reduced compared with the example without correcting the output of the paper feeding motor controller 25 (FIG. 6B). In addition, it can be confirmed that, at 1.6 seconds or so and thereafter in the time axis, the movable member 8 starts returning to the reference position (the position at 0 in the vertical axis in FIG. 7B), and the movable member 8 completely returns to the reference position by the beginning of the next paper feeding cycle (at 2.4 seconds or so in the time axis). Therefore, the displacement of the movable member 8 does not accumulate at the every paper feeding cycle, and the movable member 8 can be prevented from moving out of the movable range effectively.

As has been explained above in detail using some specific examples, in the inkjet printer according to the first embodiment, the movable member encoder 14 detects the position of the movable member 8, the correction value calculator 26 calculates a correction value based on the amount of displacement of the movable member 8 from the reference position and the integration of the amount of displacement, and the correction value calculated by the correction value calculator 26 is used to correct the voltage instruction value output from the paper feeding motor controller 25 to the paper feeding motor 9. In this manner, the inkjet printer according to the first embodiment can control the amount of displacement of the movable member 8 with an excellent responsiveness at the short paper feeding cycle corresponding to the print width of the printer head 2 to effectively prevent the movable member 8 from moving out of the movable range. Therefore, problems such as damages of the movable member 8 caused by the movable member 8 colliding with the inner surface of the housing of the inkjet printer or other components, vibrations or abnormal noise caused by collisions of the movable member 8, or smearing of the roll paper 1 during conveyance can be avoided.

Furthermore, in the inkjet printer according to the first embodiment, a change in the load corresponding to the amount of the remaining roll paper 1 and the like is absorbed appropriately by the displacement of the responsive movable member 8, and is not carried over to the carriage rollers 7. Therefore, the amount of the paper conveyed by the carriage rollers 7 can be controlled highly precisely to prevent a print deviation caused by a low paper feeding precision effectively. Particularly, the carriage rollers 7 can feed paper to the printing position precisely because the driven roller 7*b* is used as a pressing roller in the carriage rollers 7 to increase the paper holding force between the nip, thereby preventing a print deviation reliably.

Furthermore, in the inkjet printer according to the first embodiment, even if the paper feeding rollers 6 slip upon pulling and conveying the roll paper 1 having a large moment of inertia, the displacement of the movable member 8 having a excellent responsiveness can appropriately absorb the error in the amount of the paper being fed caused by the slippage of the paper feeding rollers 6, and such an error is not carried over to the carriage rollers 7. Therefore, the amount of the paper conveyed by the carriage rollers 7 can be controlled highly precisely to prevent a print deviation caused by a low paper feeding precision effectively.

Second Embodiment

An inkjet printer according to a second embodiment of the present invention will be explained next. In the example explained in the second embodiment; a driving current supplied to the paper feeding motor 9 is detected; and a reference position of the movable member 8 is switched based on the detected driving current supplied to the paper feeding motor 9. Because the basic configurations of the paper conveying mechanism and the control system included in the inkjet printer are the same as those according to the first embodiment, components that are the same as those according to the first embodiment are given the same reference numerals, redundant explanations thereof are omitted hereunder, and characteristic parts of the second embodiment alone will be explained.

In the first embodiment, the reference position of the movable member 8 is a preset fixed value. The movable range of the movable member 8 is determined by the layout where the movable member 8 is arranged inside of the housing of the inkjet printer. Therefore, by using the midpoint of the movable range as the reference position of the movable member 8, a movable range of the movable member 8 can be ensured in both of the directions to increase and to decrease the amount of the roll paper 1 unwound between the paper feeding rollers 6 and the carriage rollers 7 in an averaged manner. However, as described above, the responsiveness of the paper feeding operation performed by the paper feeding rollers 6 changes depending on the amount of the roll paper 1 remaining in the roll, and the direction in which the movable member 8 is displaced more is also determined by the amount of the remaining roll paper 1. Therefore, the reference position of the movable member 8 in the movable range can be switched depending on the amount of the remaining roll paper 1 to ensure a wider movable range in the direction in which the movable member 8 is displaced more, so that the movable member 8 is more effectively prevented from colliding with the inner surface of the housing of the inkjet printer or other components.

Figure 8A:
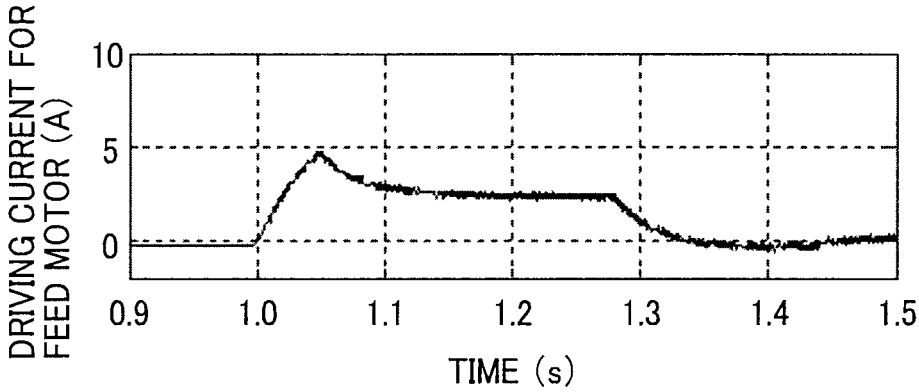
FIG. 8A is a graph of a waveform of a driving current for driving the feed motor when a medium amount of the roll paper remains in the roll.
Figure 8B:
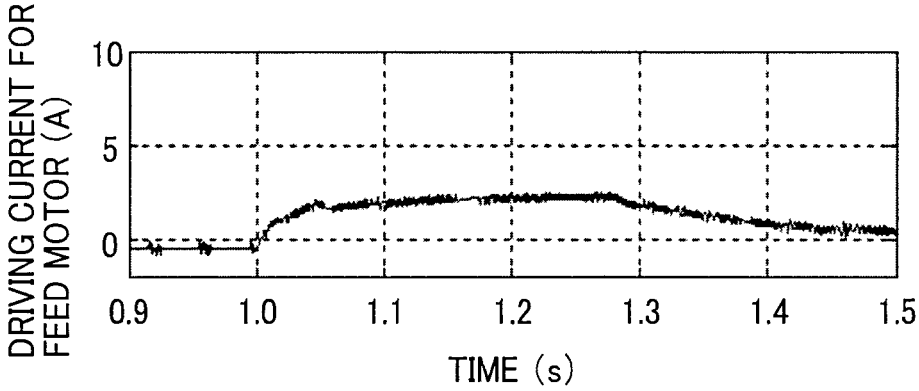
FIG. 8B is a graph of a waveform of the driving current for driving the feed motor when a small amount of the roll paper remains in the roll.
Figure 8C:
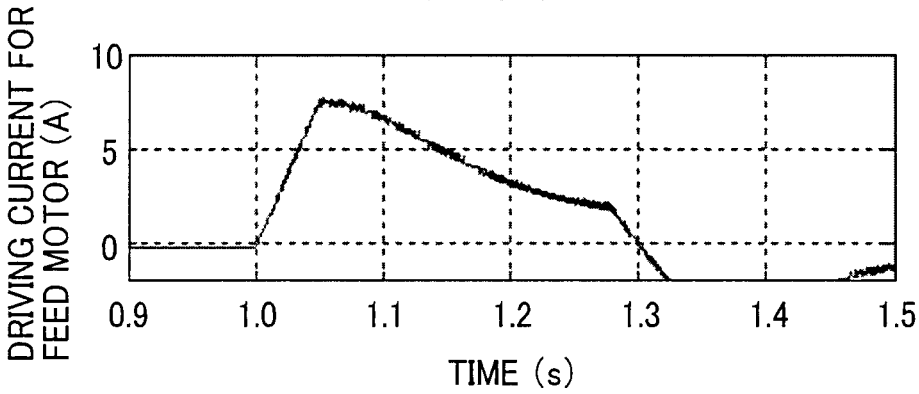
FIG. 8C is a graph of a waveform of the driving current for driving the feed motor when a large amount of the roll paper remains in the roll.

A change in the amount of the roll paper 1 remaining in the roll appears as a change in the waveform of the driving current supplied to the paper feeding motor 9 as illustrated in FIGS. 8A to 8C. FIG. 8A indicates a waveform of the driving current for driving the paper feeding motor 9 when a medium amount of the roll paper 1 remains in the roll. FIG. 8B indicates a waveform of the driving current for driving the paper feeding motor 9 when a small amount of the roll paper 1 remains in the roll. FIG. 8C indicates a waveform of the driving current for driving the paper feeding motor 9 when a large amount of the roll paper 1 remains in the roll. As it is clear by comparing FIGS. 8A, 8B, and 8C, the change in the driving current driving the paper feeding motor 9 appears prominently depending on the amount of the roll paper 1 remaining in the roll especially when the speed of the paper feeding rollers 6 is accelerated (at 1 second to 1.1 seconds in the time axis). The driving current reaches approximately 2.5 amperes when a small amount of the roll paper 1 remains, approximately 5 amperes when a medium amount of the roll paper 1 remains, and approximately 7.5 amperes when a large amount of the roll paper remains.

Therefore, in the inkjet printer according to the second embodiment, the driving current supplied to the paper feeding motor 9 is detected and input to the CPU 20, and the CPU 20 determines the reference position of the movable member 8 based on the driving current for the paper feeding motor 9, that is, the amount of the remaining roll paper 1 appearing as a change in the driving current for the paper feeding motor 9. The reference position of the movable member 8 thus determined by the CPU 20 is then input to the correction value calculator 26, and the correction value calculator 26 calculates a correction value for returning the movable member 8 to the reference position determined based on the amount of the remaining roll paper 1.

Figure 9:
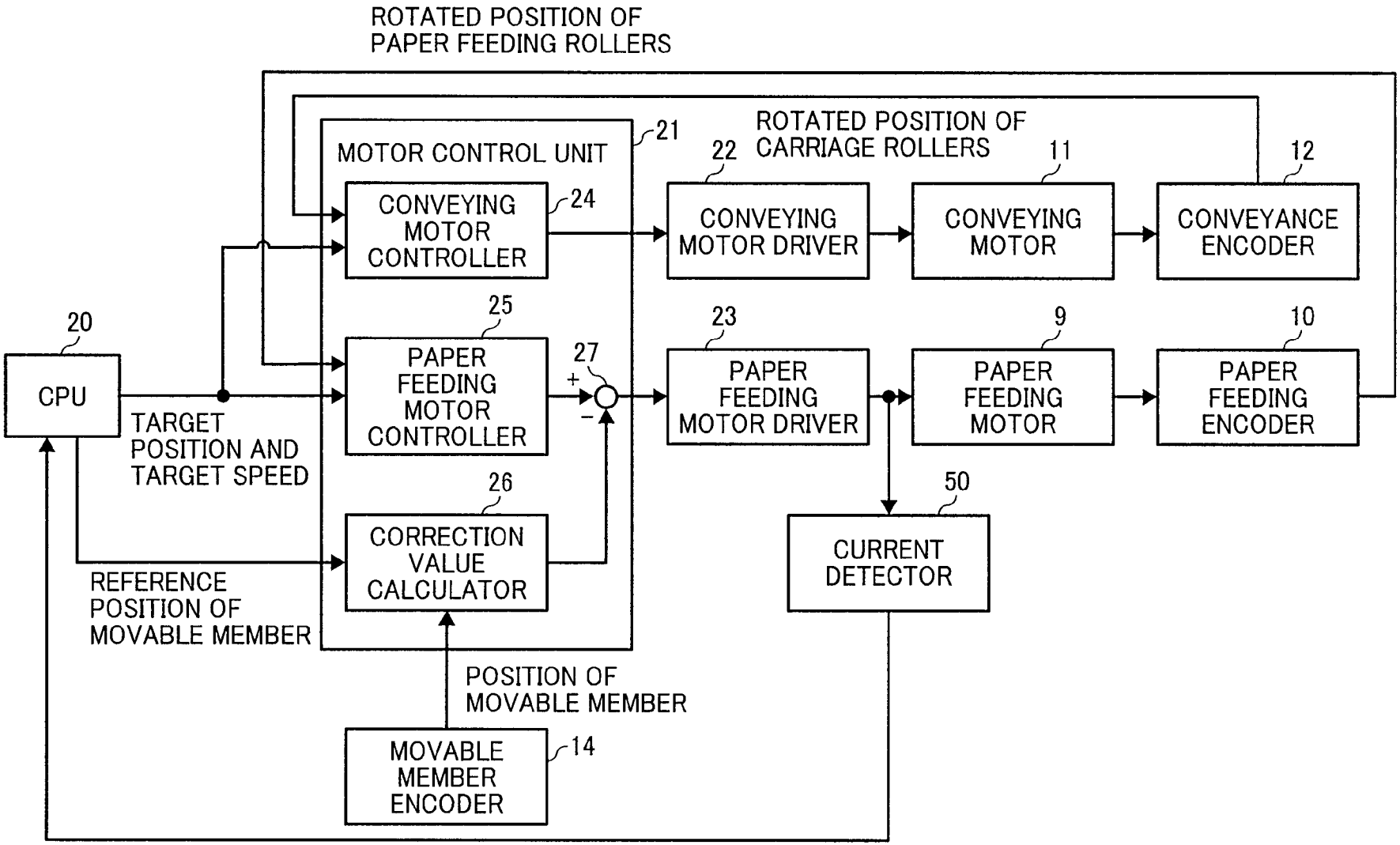
FIG. 9 is a block diagram of a configuration of a control system related to conveyance of paper in an inkjet printer according to a second embodiment of the present invention.

FIG. 9 is a block diagram of a configuration of a control system related to the conveyance of the paper in the inkjet printer according to the second embodiment. In the inkjet printer according to the second embodiment, as a control function related to the conveyance of the paper, a current detector 50 for detecting the driving current supplied from the paper feeding motor driver 23 to the paper feeding motor 9 is added to the configuration according to the first embodiment (see FIG. 3). In addition, information of the driving current for the paper feeding motor 9 detected by the current detector 50 is input to the CPU 20; and the CPU 20 outputs, to the correction value calculator 26, information of the reference position of the movable member 8 determined thereby based on the driving current of the paper feeding motor 9.

Figure 10:
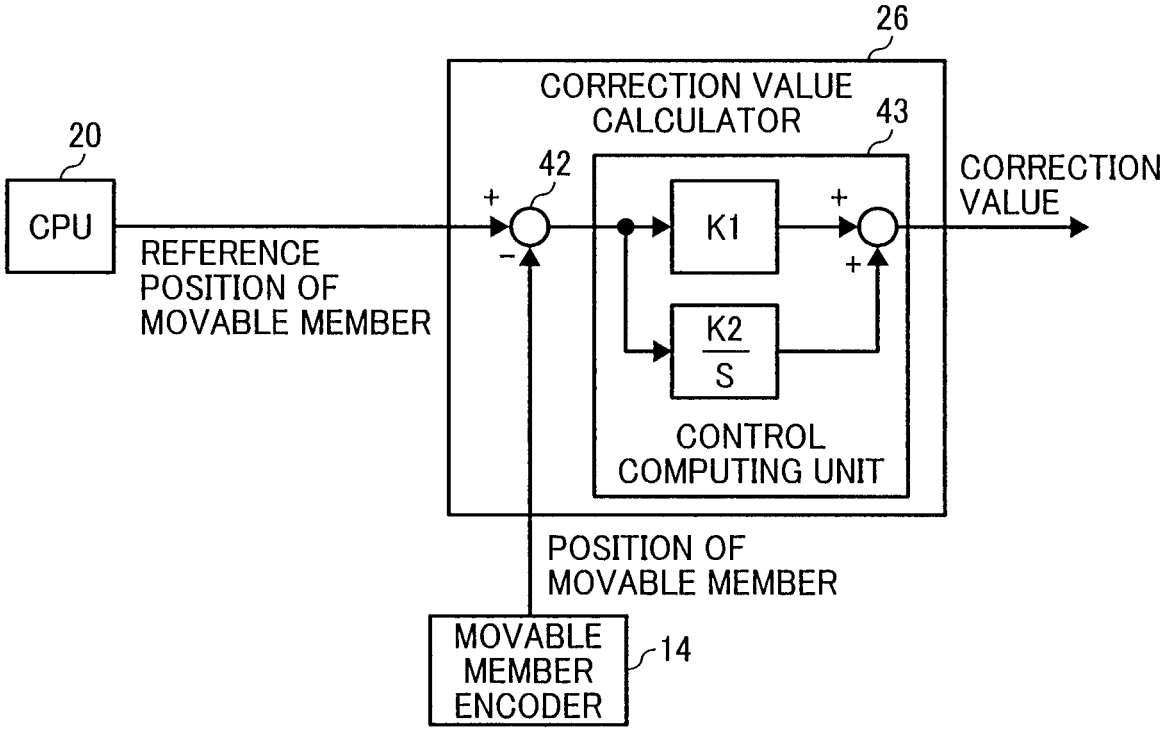
FIG. 10 is a block diagram of an internal configuration of a correction value calculator included in the inkjet printer according to the second embodiment.

FIG. 10 is a block diagram of an internal configuration of the correction value calculator 26 included in the inkjet printer according to the second embodiment. In the inkjet printer according to the second embodiment, the correction value calculator 26 does not include the reference position storage unit 41 according to the first embodiment (see FIG. 5), and the reference position of the movable member 8 determined by the CPU 20 based on the driving current of the paper feeding motor 9 is input to the subtractor 42. The subtractor 42 calculates the difference between the reference position of the movable member 8 received from the CPU 20 and the current position of the movable member 8 detected by the movable member encoder 14, that is, the subtractor 42 calculates the amount of displacement of the movable member 8 from the reference position. The control computing unit 43 outputs a voltage in proportion to the amount of displacement of the movable member 8 calculated by the subtractor 42 and the integration of the amount of displacement as a correction value for correcting the output of the paper feeding motor controller 25.

As described above, in the inkjet printer according to the second embodiment, the current detector 50 detects the driving current supplied to the paper feeding motor 9 and inputs the driving current to the CPU 20; the CPU 20 determines the reference position of the movable member 8 based on the driving current of the paper feeding motor 9; and the correction value calculator 26 calculates a correction value based on the amount of displacement of the movable member 8 from the reference position determined by the CPU 20 and the integration of the amount of displacement. Therefore, a wider movable range can be ensured in the direction in which the movable member 8 is more displaced based on the amount of the roll paper 1 remaining in the roll to prevent the movable member 8 from colliding with the inner surface of the housing of the inkjet printer or other components more effectively.

Third Embodiment

An inkjet printer according to a third embodiment of the present invention will now be explained. In the example explained in the third embodiment, the driving current supplied to the paper feeding motor 9 is detected, and the feedback gain of the paper feeding motor controller 25 and the parameters used in calculating the target speed (the target speed profile mentioned above) being changed in time series at every control cycle are switched based on a change in the detected driving current of the paper feeding motor 9. Because the basic configurations of the paper conveying mechanism and the control system included in the inkjet printer are the same as those according to the first embodiment, components that are the same as those according to the first embodiment are given the same reference numerals, redundant explanations thereof are omitted hereunder, and characteristic parts of the third embodiment alone will be explained.

As mentioned earlier, the responsiveness of the paper feed performed by the paper feeding rollers 6 changes depending on the amount of the roll paper 1 remaining in the roll. Therefore, it can be expected that, by changing the gain of the feedback control and the parameters for calculating the target speed changing in time series based on the amount of the remaining roll paper 1 within the range in which the feedback control of the paper feeding motor controller 25 can be performed in a stable manner without causing any oscillation, the paper feeding rollers 6 can pull and convey the roll paper 1 in a stable manner regardless of a change in the amount of the remaining roll paper 1, and the amount of displacement of the movable member 8 may be controlled in a stable manner. In addition, the amount of the roll paper 1 remaining in the roll may be estimated by detecting the driving current supplied to the paper feeding motor 9.

Therefore, in the inkjet printer according to the third embodiment, the driving current supplied to the paper feeding motor 9 is stored in the motor control unit 21, and the paper feeding motor controller 25 changes the feedback gain of the PI control performed in the control computing unit 34 and the parameters used by the target speed profile generating unit 31 in calculating the target speed based on the change in the driving current for the paper feeding motor 9.

The paper feeding motor controller 25 can calculate the amount of a change in the roll paper 1 remaining in the roll (the mass of the roll) and the amount of a change in the moment of inertia based on a change in the driving current driving the paper feeding motor 9 in the manner described below:

Based on the equation of motion,

Torque generated by Paper feeding motor 9 (Driving Current×Torque Constant)-Static Friction Torque of Roll Paper 1 about Motor Shaft=Moment of Inertia about Motor Axis× Acceleration of Paper feeding motor 9

At this time, because the acceleration of the paper feeding motor 9 is zero when the paper feeding motor 9 is operating at a constant speed, Torque Generated By Paper feeding motor 9 (Driving Current×Torque Constant)=Static Friction Torque of Roll Paper 1 about Motor Shaft=Friction Coefficient×Mass of Roll Therefore, a change in the mass of the roll can be obtained from the amount of a change in the driving current for the paper feeding motor 9. Furthermore, based on the equation above, the amount of a change in the moment of inertia can be obtained from the driving current of the accelerating paper feeding motor 9 and acceleration thereof. The angular acceleration of the paper feeding motor 9 can be obtained from the detection value of the paper feeding encoder 10 and the gear reduction ratio between the paper feeding motor 9 and the paper feeding roller 6.

In the paper feeding motor controller 25, in the manner described above, the feedback gain and the parameters used by the target speed profile generating unit 31 in calculating the target speed are optimized based on the mass of the roll and the moment of inertia obtained from the driving current for the paper feeding motor 9.

Figure 11:
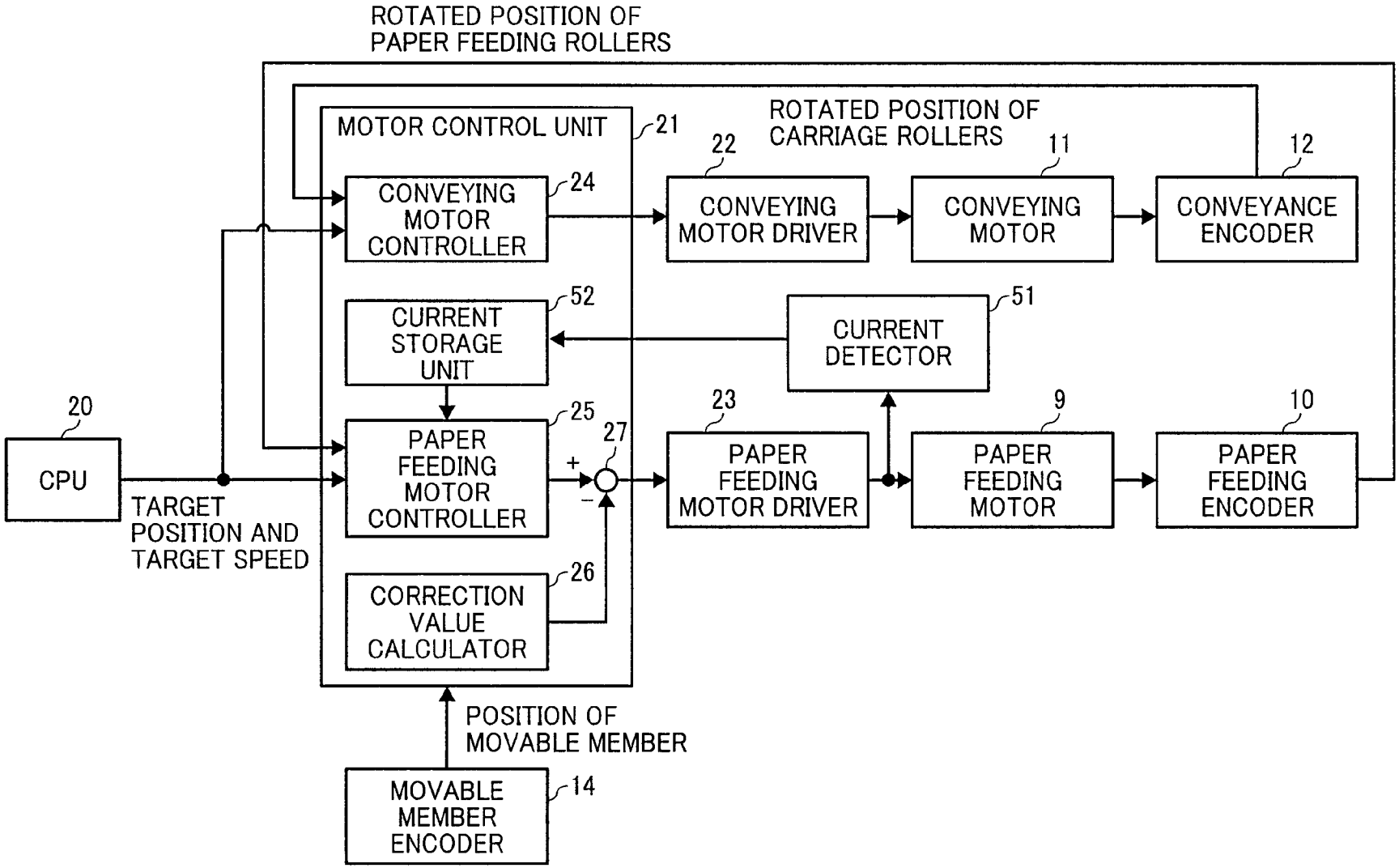
FIG. 11 is a block diagram of a configuration of a control system related to conveyance of paper in an inkjet printer according to a third embodiment of the present invention.

FIG. 11 is a block diagram of a configuration of a control system related to the conveyance of the paper in the inkjet printer according to the third embodiment. In the inkjet printer according to the third embodiment, as a control function related to the conveyance of the paper, a current detector 51 for detecting the driving current supplied from the paper feeding motor driver 23 to the paper feeding motor 9 is added to the configuration according to the first embodiment (see FIG. 3). In addition, the motor control unit 21 includes a current storage unit 52 for storing therein the driving current driving the paper feeding motor 9 detected by the current detector 51 to allow the paper feeding motor controller 25 to obtain the driving current driving the paper feeding motor 9 from the current storage unit 52.

Figure 12:
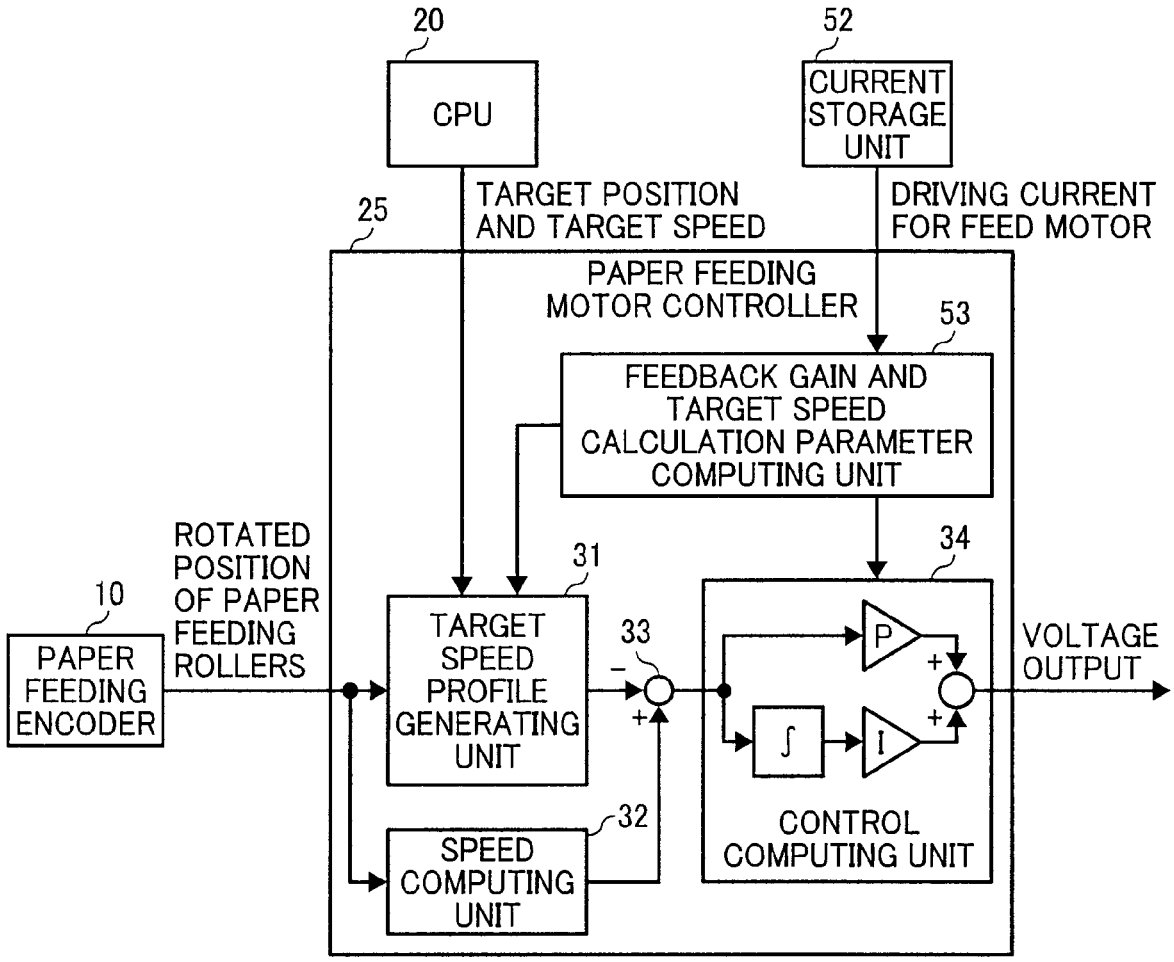
FIG. 12 is a block diagram of an internal configuration of a feed motor controller included in the inkjet printer according to the third embodiment.

FIG. 12 is a block diagram of an internal configuration of the paper feeding motor controller 25 included in the inkjet printer according to the third embodiment. In the inkjet printer according to the third embodiment, the paper feeding motor controller 25 includes a feedback gain and target speed calculation parameter computing unit 53.

The feedback gain and target speed calculation parameter computing unit 53 obtains the driving current driving the paper feeding motor 9 from the current storage unit 52, and estimates the amount of the roll paper 1 remaining in the roll based on the driving current for the paper feeding motor 9 as described above. In other words, because the torque constant of the paper feeding motor 9 is known in advance, the torque generated by the paper feeding motor 9 may be obtained by multiplying the torque constant and the driving current of the paper feeding motor 9. Based on the equation of motion mentioned earlier, the feedback gain and target speed calculation parameter computing unit 53 approximates the load of the roll paper 1 and of the paper feeding rollers 6 combined and the moment of inertia using the torque generated by the paper feeding motor 9; and estimates the amount of the roll paper 1 remaining in the roll based on the change in the load and the change in the moment of inertia. The feedback gain and target speed calculation parameter computing unit 53 then sets the gain of the PI control performed in the control computing unit 34 to a value that is optimum for the amount of the remaining roll paper 1, and sets the parameters used by the target speed profile generating unit 31 in calculating the target speed changing time series at every control cycle to values that are optimum for the amount of the remaining roll paper 1.

Explained below with reference to FIGS. 13A to 13E is a specific example of how the conveying speed of the roll paper 1 conveyed by the paper feeding rollers 6 changes by changing the feedback gain of the PI control performed by the control computing unit 34 and the parameters used by the target speed profile generating unit 31 in calculating the target speed changing in time series at every control cycle.

Figure 13A:
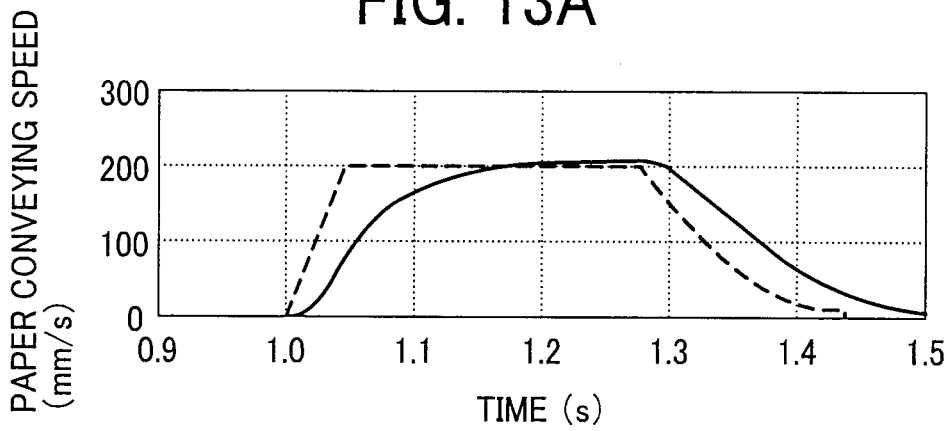
FIG. 13A is a graph of a transition of the conveying speed of the roll paper conveyed by the paper feeding rollers when a medium amount of the roll paper remains in the roll, and a feedback gain and target speed calculation parameters are set to the optimum values for the amount of the remaining roll paper.

FIG. 13A is a graph of a transition of the conveying speed of the roll paper 1 conveyed by the paper feeding rollers 6 when a medium amount of the roll paper 1 remains in the roll, and the feedback gain and target speed calculation parameter computing unit 53 included in the paper feeding motor controller 25 sets the feedback gain and the target speed calculation parameters to values that are optimum for a medium amount of the remaining roll paper 1. In FIG. 13A, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25. In this example, the proportional gain (P) and the integral gain (I) of the control computing unit 34 are set to 50 and 1300, respectively. These settings are used to make the transition of the conveying speed of the roll paper 1 conveyed by the paper feeding rollers 6 closest to the transition of the conveying speed of the roll paper 1 conveyed by the carriage rollers 7 when a medium amount of the roll paper 1 remains.

Figure 13B:
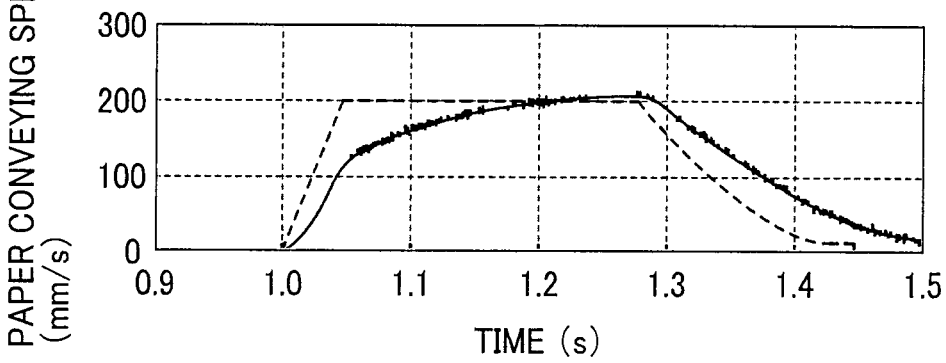
FIG. 13B is a graph of a transition of the conveying speed of the roll paper conveyed by the paper feeding rollers when the feedback gain and the target speed calculation parameters are set to the optimum values for a medium amount of the remaining roll paper despite the amount of the roll paper remaining in the roll getting smaller.

FIG. 13B is a graph of a transition of the conveying speed of the roll paper 1 conveyed by the paper feeding rollers 6 when the feedback gain and the target speed calculation parameters are kept to the values that are optimum for a medium amount of the remaining roll paper 1 although the amount of the roll paper 1 remaining in the roll is getting smaller. In FIG. 13B, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25.

Figure 13C:
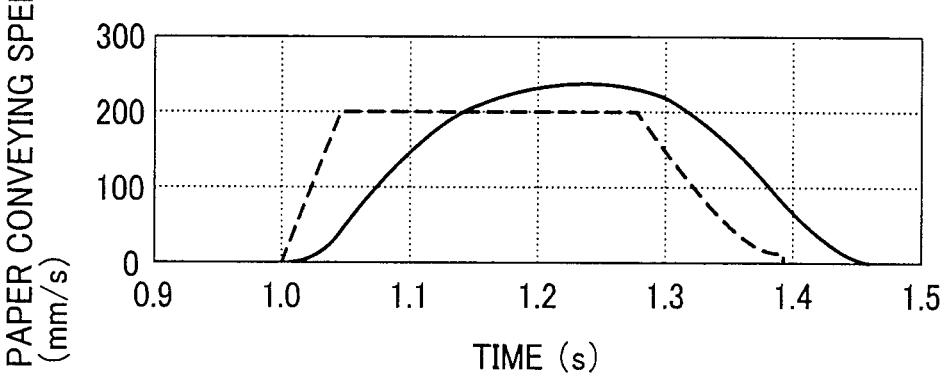
FIG. 13C is a graph of a transition of the conveying speed of the roll paper conveyed by the paper feeding rollers when the feedback gain and the target speed calculation parameters are set to the optimum values for a medium amount of the remaining roll paper despite a large amount of the roll paper remains in the roll.

On the contrary, FIG. 13C is a graph of a transition of the conveying speed of the roll paper 1 conveyed by the paper feeding rollers 6 when the feedback gain and target speed calculation parameters are kept to the values that are optimum for a medium amount of the remaining roll paper 1 although a large amount of the roll paper 1 still remains in the roll. In FIG. 13C, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25.

As indicated in FIGS. 13A to 13C, when fixed values are used as the feedback gain of the PI control performed by the control computing unit 34 and the parameters used by the target speed profile generating unit 31 in calculating the target speed changing in time series at every control cycle; the behavior of the transition of the conveying speed of the roll paper 1 conveyed by the paper feeding rollers 6 changes, depending on the amount of the roll paper 1 remaining in the roll, to increase the difference between the conveying speed of the roll paper 1 conveyed by the paper feeding rollers 6 and the conveying speed of the roll paper 1 conveyed by the carriage rollers 7. More specifically, as indicated in FIG. 13B, if the feedback gain and the target speed calculation parameters are kept to the values that are optimum for a medium amount of the remaining roll paper 1 although the amount of the roll paper 1 remaining in the roll is getting less, the acceleration and the deceleration become excessive, resulting in an increase in the difference between the conveying speed of the roll paper 1 conveyed by the paper feeding rollers 6 and the conveying speed of the roll paper 1 conveyed by the carriage rollers 7. On the contrary, as indicated in FIG. 13C, if the feedback gain and the target speed calculation parameters are kept to the values that are optimum for a medium amount of the remaining roll paper 1 although a large amount of the roll paper 1 still remains in the roll, enough acceleration or deceleration cannot be achieved, resulting in an increase in the difference between the conveying speed of the roll paper 1 conveyed by the paper feeding rollers 6 and the conveying speed of the roll paper 1 conveyed by the carriage rollers 7.

Figure 13D:
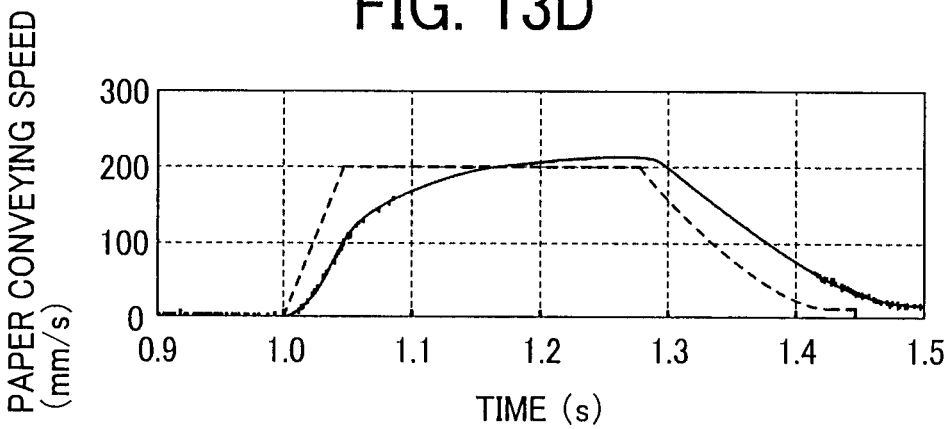
FIG. 13D is a graph of a transition of the conveying speed of the roll paper conveyed by the paper feeding rollers when a small amount of the roll paper remains in the roll, and the feedback gain and the target speed calculation parameters are set to the optimum values for the amount of the remaining roll paper.

FIG. 13D is a graph of a transition of the conveying speed of the roll paper 1 conveyed by the paper feeding rollers 6 when a small amount of the roll paper 1 remains in the roll, and the feedback gain and target speed calculation parameter computing unit 53 included in the paper feeding motor controller 25 sets the feedback gain and the target speed calculation parameters to values that are optimum for a small amount of the remaining roll paper 1. In FIG. 13D, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25. In this example, the proportional gain (P) and the integral gain (I) of the control computing unit 34 are set to 25 and 1300, respectively. These settings are to make the transition of the conveying speed of the roll paper 1 conveyed by the paper feeding rollers 6 closest to the transition of the conveying speed of the roll paper 1 conveyed by the carriage rollers 7 when a small amount of the roll paper 1 remains.

Figure 13E:
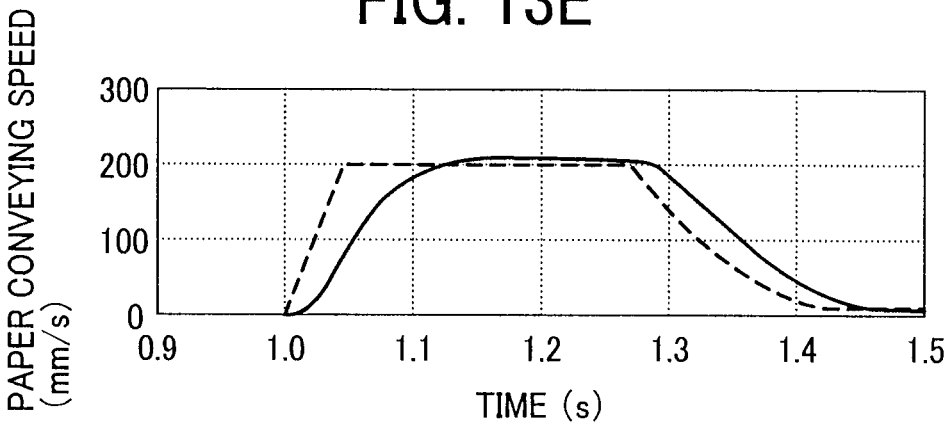
FIG. 13E is a graph of a transition of the conveying speed of the roll paper conveyed by the paper feeding rollers when a large amount of the roll paper remains in the roll, and the feedback gain and the target speed calculation parameters are set to the optimum values for the amount of the remaining roll paper.

FIG. 13E is a graph of a transition of the conveying speed of the roll paper 1 conveyed by the paper feeding rollers 6 when a large amount of the roll paper 1 remains in the roll, and the feedback gain and target speed calculation parameter computing unit 53 included in the paper feeding motor controller 25 sets the feedback gain and the target speed calculation parameters to values that are optimum for a large amount of the remaining roll paper 1. In FIG. 13E, the graph drawn in the solid line represents the transition of the conveying speed of the roll paper 1 conveyed by the paper feeding rollers 6 at the paper feeding cycle, and the graph drawn in the dashed line represents the target speed profile generated by the paper feeding motor controller 25. In this example, the proportional gain (P) and the integral gain (I) used in the control computing unit 34 are set to 115 and 1950, respectively. These settings are to make the transition of the conveying speed of the roll paper 1 conveyed by the paper feeding rollers 6 closest to the transition of the conveying speed of the roll paper 1 conveyed by the carriage rollers 7 when a large amount of the roll paper 1 remains.

As indicated in FIGS. 13D and 13E, when the feedback gain of the PI control performed by the control computing unit 34 and the parameters used by the target speed profile generating unit 31 in calculating the target speed changing in time series at every control cycle are set to the values that are optimum for the amount of the roll paper 1 remaining in the roll, the behavior of the transition of the conveying speed of the roll paper 1 conveyed by the paper feeding rollers 6 can be kept almost constant despite the changes in the amount of the remaining roll paper 1. Therefore, the paper feeding rollers 6 can pull and convey the roll paper 1 in a stable manner. By allowing the paper feeding rollers 6 to pull and convey the roll paper 1 in a stable manner, the amount of displacement of the movable member 8 can be controlled in a stable manner.

As described above, in the inkjet printer according to the third embodiment, the current detector 51 detects the driving current supplied to the paper feeding motor 9, and stores the driving current in the current storage unit 52 included in the motor control unit 21. The feedback gain and target speed calculation parameter computing unit 53 included in the paper feeding motor controller 25 then obtains the driving current of the paper feeding motor 9 from the current storage unit 52 to estimate the amount of the roll paper 1 remaining in the roll; and changes the feedback gain of the PI control performed by the control computing unit 34 and the parameters used by the target speed profile generating unit 31 in calculating the target speed to the values that are optimum for the amount of the remaining roll paper 1. Therefore, the behavior of the transition of the conveying speed of the roll paper 1 conveyed by the paper feeding rollers 6 can be kept almost constant despite the changes in the amount of the remaining roll paper 1 to allow the paper feeding rollers 6 to pull and convey the roll paper 1 in a stable manner. Therefore, the amount of displacement of the movable member 8 may be controlled in a stable manner.

Fourth Embodiment

An inkjet printer according to a fourth embodiment of the present invention will now be explained. The fourth embodiment is a variation of the third embodiment, and the driving current of the paper feeding motor 9 is estimated internally within the paper feeding motor controller 25, instead of being detected by the current detector 51. Components that are the same as those according to the third embodiment are given the same reference numerals, redundant explanations thereof are omitted hereunder, and characteristic parts of the fourth embodiment alone will be explained.

Figure 14:
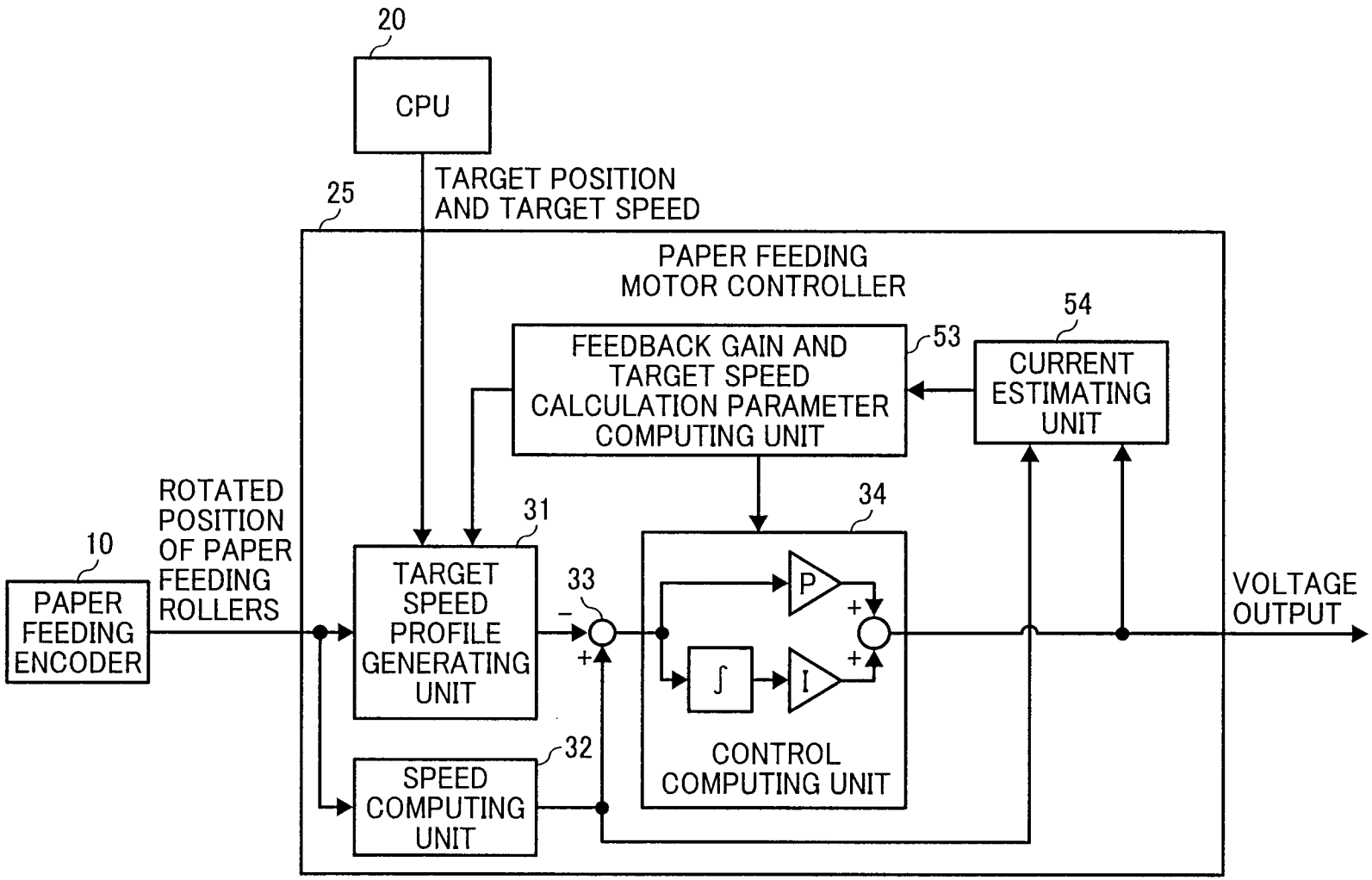
FIG. 14 is a block diagram of an internal configuration of a feed motor controller included in an inkjet printer according to a fourth embodiment of the present invention.

FIG. 14 is a block diagram of an internal configuration of the paper feeding motor controller 25 included in the inkjet printer according to the fourth embodiment. In the inkjet printer according to the fourth embodiment, the paper feeding motor controller 25 includes a current estimating unit 54.

The current estimating unit 54 receives inputs of the voltage applied to the paper feeding motor 9 calculated by the control computing unit 34 and information of the rotation speed of the paper feeding rollers 6 calculated by the speed computing unit 32; and estimates the driving current of the paper feeding motor 9 based on the voltage applied to the paper feeding motor 9 and an approximation of the rotation speed of the paper feeding motor 9 obtained from the rotation speed of the paper feeding rollers 6 and the gear reduction ratio. More specifically, the current estimating unit 54 calculates a back electromotive force by multiplying a back electromotive force constant by the rotation speed of the paper feeding motor 9. The effective voltage of the paper feeding motor 9 is then obtained by subtracting the back electromotive force from the voltage applied to the paper feeding motor 9. A filter consisting of a resistor and an inductance is then applied to the effective voltage of the paper feeding motor 9 to estimate the driving current supplied from the paper feeding motor driver 23 to the paper feeding motor 9.

To explain more in detail, because:

i) Effective Voltage=(Voltage Applied-Back Electromotive Force), and ii) Current=Effective Voltage×(Transfer Function of First-Order Lag of Time Constant (La/Ra), where Ke is the torque constant (=back electromotive force constant), La is the inductance, and Ra is the armature resistance, the driving current I of the paper feeding motor 9 can be obtained by:

$$I=(V-Ke\cdot\omega)\times(1/((La/Ra)\times S+1)),$$

where ω is the number of revolutions of the paper feeding motor 9, S is a Laplace operator, and V is the voltage applied to the paper feeding motor 9. Because this is a differential equation, it can be solved numerically using a general integration algorithm such as Runge-Kutta method. In the case of a digital control, the equation can be converted into a difference equation by a bilinear transform. In this manner, the driving current of the paper feeding motor 9 can be estimated. In addition, the torque applied by the paper feeding motor 9 to the roll paper 1 and the paper feeding rollers 6, that is, the load torque of the roll paper 1 and the paper feeding rollers 6 (acceleration torque+static friction torque) can be estimated. The moment of inertia can also be estimated based on the acceleration torque (driving current×torque constant) and the angler acceleration of the paper feeding motor 9 at that time. As a method for approximating the current estimate value from the voltage applied to the paper feeding motor 9, there is a method of dividing the voltage applied to the paper feeding motor 9 by the resistance while ignoring the effect of the inductance under the assumption that the paper feeding motor 9 is at a steady condition in which it rotates at a constant speed.

The estimate value of the driving current of the paper feeding motor 9 calculated by the current estimating unit 54 is input to the feedback gain and target speed calculation parameter computing unit 53. The feedback gain and target speed calculation parameter computing unit 53 then estimates the amount of the roll paper 1 remaining in the roll based on the estimate value of the driving current of the paper feeding motor 9 calculated by the current estimating unit 54; and sets the gain of the PI control performed by the control computing unit 34 to the value that is optimum for the amount of the remaining roll paper 1; and also sets the parameters used by the target speed profile generating unit 31 in calculating the target speed changing in time series at every control cycle to the values that are optimum for the amount of the remaining roll paper 1 in the same manner as in the third embodiment.

As described above, in the inkjet printer according to the fourth embodiment, the driving current of the paper feeding motor 9 is estimated internally within the paper feeding motor controller 25, instead of being detected by the current detector 51, and the feedback gain used in the paper feeding motor controller 25 and the parameters used in calculating the target speed are changed based on the estimate value of the driving current. Therefore, the same advantages achieved in the third embodiment can be achieved without requiring the current detector 51. The fourth embodiment is explained above as a variation of the third embodiment. However, the technique of estimating the driving current of the paper feeding motor 9 based on the voltage output from the paper feeding motor controller 25 may be applied to the second embodiment, and may be implemented as a variation of the second embodiment. In such an example, by allowing the CPU 20 to estimate the driving current applied to the paper feeding motor 9 and to determine the reference position of the movable member 8, the same advantages achieved in the second embodiment can be achieved without requiring the current detector 50.

Fifth Embodiment

An inkjet printer according to a fifth embodiment of the present invention will now be explained. The fifth embodiment is a variation of the fourth embodiment, and the torque constant, the armature resistance, and the inductance of the paper feeding motor 9 are stored as data that is unique to the paper feeding motor 9, and the driving current of the paper feeding motor 9 is estimated using the unique data thus stored. Components that are the same as those according to the fourth embodiment are given the same reference numerals, redundant explanations thereof are omitted hereunder, and characteristic parts of the fifth embodiment alone will be explained.

Figure 15:
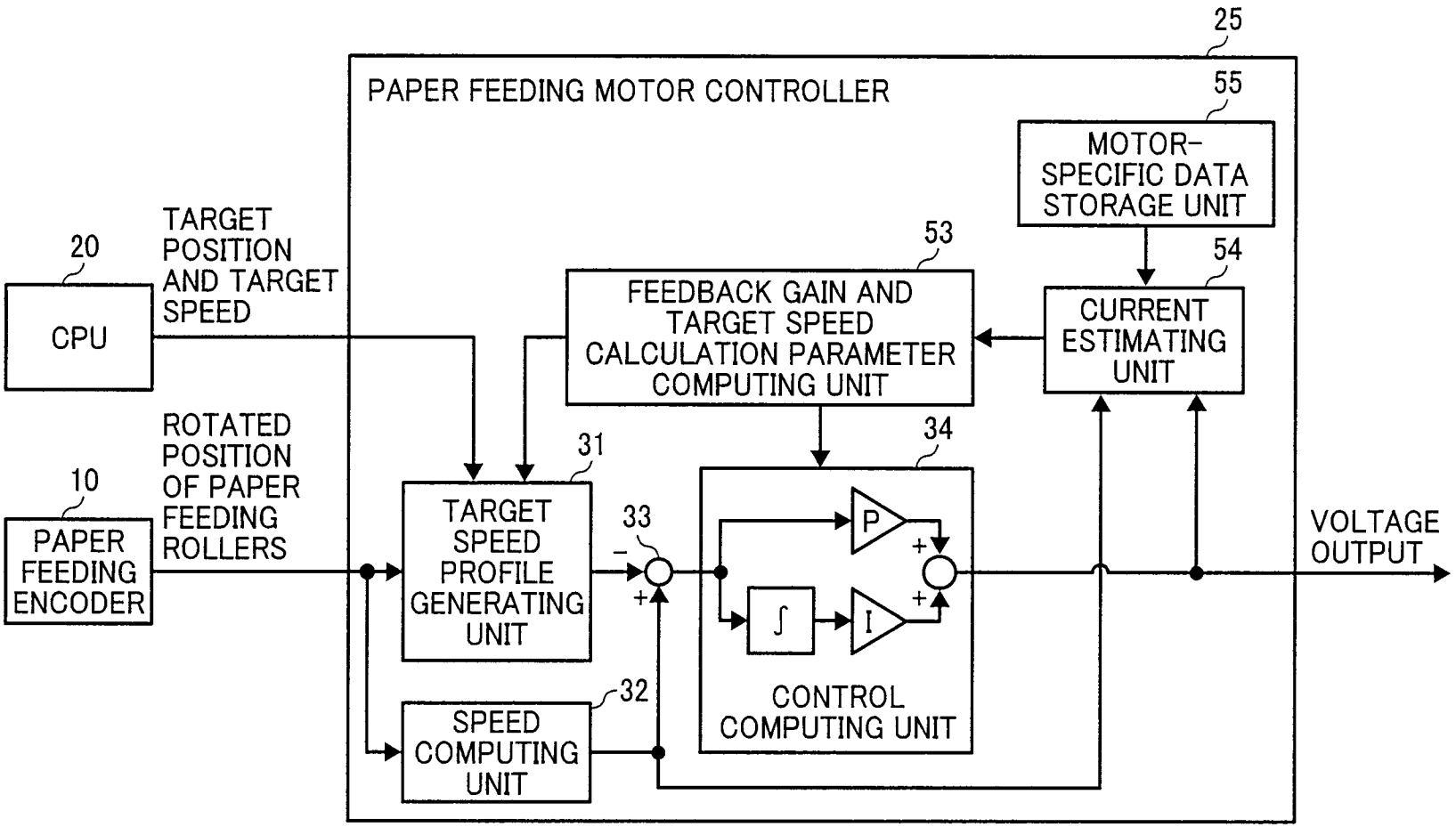
FIG. 15 is a block diagram of an internal configuration of a feed motor controller included in an inkjet printer according to a fifth embodiment of the present invention.

FIG. 15 is a block diagram of an internal configuration of the paper feeding motor controller 25 included in the inkjet printer according to the fifth embodiment. In the inkjet printer according to the fifth embodiment, the paper feeding motor controller 25 includes a motor-specific data storage unit 55.

The motor-specific data storage unit 55 stores therein the torque constant, the armature resistance, and the inductance that are characteristic values unique to the paper feeding motor 9. These characteristic values unique to the paper feeding motor 9 stored in the motor-specific data storage unit 55 are written over with new characteristic values when the paper feeding motor 9 fails and is replaced with a new motor. In other words, the motor-specific data storage unit 55 stores therein the characteristic values that are specific to the motor currently being used as the paper feeding motor 9. The reason why the characteristic values specific to the paper feeding motor 9 is stored in the motor-specific data storage unit 55 is that the precision of the estimate value of the driving current is lowered when the paper feeding motor 9 is replaced, for example, if the driving current is estimated using the fixed characteristic values for the paper feeding motor 9, because there are fluctuations of these characteristic values in each motor.

In the inkjet printer according to the fifth embodiment, the current estimating unit 54 included in the paper feeding motor controller 25 estimates the driving current of the paper feeding motor 9 based on the voltage applied to the paper feeding motor 9 calculated by the control computing unit 34 and the information of the rotation speed of the paper feeding rollers 6 calculated by the speed computing unit 32 using the torque constant, the armature resistance, and the inductance of the paper feeding motor 9 stored in the motor-specific data storage unit 55. Based on the estimate value of the driving current for the paper feeding motor 9, the feedback gain and target speed calculation parameter computing unit 53 estimates the amount of the roll paper 1 remaining in the roll, and sets the gain of the PI control performed by the control computing unit 34 to the value optimum for the amount of the remaining roll paper 1, as well as the parameters used by the target speed profile generating unit 31 in calculating the target speed changing in time series at every control cycle to the values that are optimum values for the amount of the remaining roll paper 1.

As described above, in the inkjet printer according to the fifth embodiment, the torque constant, the armature resistance, and the inductance that are characteristic values unique to the motor currently being used as the paper feeding motor 9 are stored in the motor-specific data storage unit 55, and the current estimating unit 54 estimates the driving current of the paper feeding motor 9 using the torque constant, the armature resistance, and the inductance of the paper feeding motor 9 stored in the motor-specific data storage unit 55. Therefore, even if the paper feeding motor 9 is replaced with a new motor, e.g., due to a failure of the motor, the driving current of the paper feeding motor 9 can be estimated highly precisely.

Specific examples of the inkjet printer according to the present invention are explained above in the first to the fifth embodiments. However, the present invention is not limited to each of the embodiments as it is, and may be implemented with the components thereof modified within the scope of the present invention at the implementation stage without deviating from the spirit thereof.

According to the present invention, the output of the feed motor control unit performing feedback control of the feed motors is corrected using a correction value based on the amount of displacement of the movable member from the reference position and the integration of the amount of displacement. Therefore, the amount of displacement of the movable member can be controlled responsively within a short paper feeding cycle, so that the movable member is effectively prevented from being displaced out of the movable range, further to prevent damages of the movable member, vibrations or abnormal noise, and smearing of the paper as a result of collision with the inner surface of the housing of the machine or other components.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A roll paper conveying apparatus comprising:

a carriage roller that is driven by a conveying motor, and intermittently conveys roll paper by an amount of paper to be fed corresponding to a predetermined print width to a predetermined printing position;

a paper feeding roller that is driven by a feed motor, unwinds the roll paper, and pulls and conveys the roll paper toward the carriage roller intermittently;

a first detecting unit that detects a rotation angle of the paper feeding roller;

a feed motor control unit that performs feedback control of the feed motor using a detection value of the first detecting unit so that a conveying speed and a conveying position of the roll paper follow target values;

a movable member that is kept in contact with the roll paper at a position between the paper feeding roller and the carriage roller, and is displaced from a reference position to absorb a change in a tensile force of the roll paper caused by a difference between rotation speeds of the paper feeding roller and the carriage roller;

a second detecting unit that detects a position of the movable member; and a correcting unit that calculates a correction value corresponding to an amount of displacement of the movable member from the reference position and an integration of the amount of displacement based on a detection value of the second detecting unit and corrects an output of the feed motor control unit using the correction value thus calculated.

2. The roll paper conveying apparatus according to claim 1, further comprising:

a current detecting unit that detects or estimates a driving current supplied to the feed motor; and a reference position determining unit that determines the reference position of the movable member based on a current detected or estimated by the current detecting unit, wherein the correcting unit uses a difference between the reference position determined by the reference position determining unit and the detection value of the second detecting unit as the amount of displacement.

3. The roll paper conveying apparatus according to claim 1, further comprising a current detecting unit that detects or estimates a driving current supplied to the feed motor, wherein the feed motor control unit changes parameters used in calculating a gain of the feedback control and a roll paper target speed changing in time series, based on a current detected or estimated by the current detecting unit.

4. The roll paper conveying apparatus according to claim 2, further comprising a storage unit that stores therein a torque constant, an electrical resistance, and an inductance of the feed motor as data specific to the feed motor, wherein the current detecting unit estimates the driving current supplied to the feed motor using the specific data stored in the storage unit.

5. The roll paper conveying apparatus according to claim 3, further comprising a storage unit that stores therein a torque constant, an electrical resistance, and an inductance of the feed motor as data specific to the feed motor, wherein the current detecting unit estimates the driving current supplied to the feed motor using the specific data stored in the storage unit.

6. An inkjet printer that includes the roll paper conveying apparatus according to claim 1, further comprising;

a printer head that scans the roll paper in a main-scanning direction while conveying of the roll paper is stopped and applies ink to the roll paper intermittently conveyed by the carriage roller included in the roll paper conveying apparatus to the printing position.

7. A roll paper conveying method comprising:

intermittently conveying roll paper by an amount of paper to be fed corresponding to a predetermined print width to a predetermined printing position with a carriage roller that is driven by a conveying motor;

unwinding the roll paper, and pulling and conveying the roll paper toward the carriage roller intermittently with a paper feeding roller that is driven by a feed motor;

detecting a rotation angle of the paper feeding roller with a first detecting unit;

performing feedback control of the feed motor using a detection value of the first detecting unit so that a conveying speed and a conveying position of the roll paper follow target values of a feed motor control unit;

keeping a movable member in contact with the roll paper at a position between the paper feeding roller and the carriage roller, and displacing the movable member from a reference position to absorb a change in a tensile force of the roll paper caused by a difference between rotation speeds of the paper feeding roller and the carriage roller;

detecting a position of the movable member with a second detecting unit; and calculating, with a correcting unit, a correction value corresponding to an amount of displacement of the movable member from the reference position and an integration of the amount of displacement based on a detection value of the second detecting unit and correcting an output of the feed motor control unit using the correction value thus calculated.

* * * * *